US006850727B2

(12) United States Patent
Noya et al.

(10) Patent No.: US 6,850,727 B2
(45) Date of Patent: Feb. 1, 2005

(54) IMAGE-FORMING APPARATUS WITH STANDARD AND GLOSS FIXING DEVICES

(75) Inventors: Motoi Noya, Nakai-machi (JP); Yutaka Nogami, Nakai-machi (JP); Yoshio Kanesawa, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 10/358,318

(22) Filed: Feb. 5, 2003

(65) Prior Publication Data

US 2003/0180074 A1 Sep. 25, 2003

(30) Foreign Application Priority Data

Mar. 19, 2002 (JP) ..... 2002-076850
Sep. 20, 2002 (JP) ..... 2002-275880

(51) Int. Cl.[7] ..... G03G 15/20
(52) U.S. Cl. ..... 399/328
(58) Field of Search ..... 399/328, 320; 219/216

(56) References Cited

U.S. PATENT DOCUMENTS 5,659,864 A * 8/1997 Oka et al. ..... 399/321
6,192,213 B1 * 2/2001 Wada et al. ..... 399/306

FOREIGN PATENT DOCUMENTS

JP B2 4-31393 5/1992
JP A 5-158364 6/1993
JP 2002-196598 * 7/2002

* cited by examiner

*Primary Examiner*—Quana Grainger
(74) *Attorney, Agent, or Firm*—Oliff & Berridge, PLC

(57) ABSTRACT

An image-forming apparatus is provided which includes: an image forming part that forms an unfixed toner image on a recording sheet; a first fixing part that performs primary fixation to the recording sheet that bears the unfixed toner image; and a second fixing part that performs secondary fixation to the recording sheet fixed by the first fixing part. In the image-forming apparatus, the second fixing part exists above the image forming part.

28 Claims, 15 Drawing Sheets

IMAGE-FORMING APPARATUS WITH STANDARD AND GLOSS FIXING DEVICES

FIELD OF THE INVENTION AND RELATED ART STATEMENT

The present invention relates to an image-forming apparatus using an electrophotographic system, such as a copying machine, a printer, a facsimile, or a combination machine of the above machines, and more specifically to an image-forming apparatus provided with two fixing devices.

DESCRIPTION OF THE RELATED ART

An image-forming apparatus that utilizes an electrophotographic system (electrostatic transfer system), such as a copying machine or a printer is widely known. In particular, a full-color electrophotographic copying machine and a full-color electrophotographic printer have been being used increasingly as printers for photographic image output of a digital still camera that has been actively introduced in the market. In this case, in terms of quality of a photographic image, an output image having a surface with high smoothness and high gloss is desired. On the other hand, as to a black-and-white output image of general text or the like, an output image with low gloss is desired.

Up to now, proposed in JP 04-31393 B is an apparatus capable of outputting an output image with high smoothness and high gloss as a separate unit from an image-forming apparatus. Further, proposed in JP 05-158364 A is a technique in which: two types of a roll fixing device and a belt fixing device are arranged in series in a main body of an image-forming apparatus; a conveying path for a recording medium is switched by using auxiliary members such as a conveying roller and a conveying guide in accordance with combination of the arrangement order and operation of the two types of fixing devices; and fixation is performed with the use of only the roll fixing device, only the belt fixing device, or both of the roll fixing device and the belt fixing device to thereby switch to a gloss, semi-gloss, or non-gloss image to be output.

However, problems to be further improved exist in the prior art described above.

First, saving of space is given. That is, in the structure disclosed in JP 04-31393 B, since the image-forming apparatus and the apparatus for output with high smoothness and high gloss need to be provided, a large installation space is required (compared with the case where one apparatus is provided). Further, in the structure disclosed in JP 05-158364 A, since two types of the fixing devices used for the output of a non-gloss image and the fixing device used for the output of a gloss image are arranged in a horizontal position (in series) in the main body of the image-forming apparatus, the size of the image-forming apparatus itself is large, which requires a large installation space.

In particular, today, the image-forming apparatus capable of forming an output image with high gloss/low gloss or no gloss has been increasingly demanded as the image-forming apparatus not only for the use at a general office but also for copy service of general text and for output of a photographic image of a digital still camera at a bookstore, an appliance store, or the like. Thus, saving of space for the image-forming apparatus is required from the perspective that the area of a shop such as a bookstore or an appliance store is effectively utilized.

Second, improvement in operability is given. That is, in the structure disclosed in JP 05-158364 A, since a recording medium on which an image has been formed is discharged from the lower side of the side surface of the image-forming apparatus, the operability is poor in the point that the discharged recording medium is difficult to be taken out. On the other hand, when the installation height of the image-forming apparatus is raised for improvement in taking-out property of the recording medium, the height of an image reading device increases correspondingly, which also leads to lowering of operability.

OBJECT AND SUMMARY OF THE INVENTION

The present invention has been made in view of the above technical problems and provides an image-forming apparatus which can output an image with high gloss and which is small in size and excellent in operability.

Hereinafter, measures for solving the technical problems are described using conceptual diagrams of FIGS. 1 and 2.

That is, an aspect of the present invention (under the consideration with a focus on a positional relationship between a second fixing part and an image forming part) relates to an image-forming apparatus that includes: an image forming part that forms an unfixed toner image on a recording sheet; a first fixing part that performs primary fixation to the recording sheet that bears the unfixed toner image; and a second fixing part that performs secondary fixation to the recording sheet fixed by the first fixing part, in which the second fixing part exists above the image forming part (refer to solid-line arrow(1) in FIG. 1). Further, another aspect of the present invention relates to an image-forming apparatus that includes: an original reading part that reads an original to obtain image information; an image forming part that forms an unfixed toner image on a recording sheet in accordance with the image information; a first fixing part that performs primary fixation to the recording sheet that bears the unfixed toner image; and a second fixing part that performs secondary fixation to the recording sheet fixed by the first fixing part, in which the second fixing part exists above the image forming part and below the original reading part (refer to the solid-line arrows(1) (2) in FIG. 1). Alternatively, the second fixing part exists above the first fixing part (refer to the solid-line arrow(3) in FIG. 1).

Another aspect of the present invention (under the consideration with a focus on a positional relationship between a second fixing part and a first fixing part) relates to an image-forming apparatus that includes: an image forming part that forms an unfixed toner image on a recording sheet; a first fixing part that performs primary fixation to the recording sheet that bears the unfixed toner image; and a second fixing part that performs secondary fixation to the recording sheet fixed by the first fixing part, in which the second fixing part exists above the first fixing part (refer to the solid-line arrow(3) in FIG. 1). Alternatively, it is possible that the second fixing part does not exist just above the first fixing part.

Further, another aspect of the present invention relates to an image-forming apparatus that includes: an original reading part that reads an original to obtain image information; an image forming part that forms an unfixed toner image on a recording sheet in accordance with the image information; a first fixing part that performs primary fixation to the recording sheet that bears the unfixed toner image; and a second fixing part that performs secondary fixation to the recording sheet fixed by the first fixing part, in which the second fixing part exists above the first fixing part and below the original reading part (refer to the solid-line arrows (3) (2) in FIG. 1). Alternatively, the second fixing part exists above the image forming part (refer to the solid-line arrows(1)in FIG. 1).

Further, another aspect of the present invention (under the consideration with a focus on a regional relationship between a second fixing part and an image forming part) relates to an image-forming apparatus that includes: an image forming part that forms an unfixed toner image on a recording sheet; a first fixing part that performs primary fixation to the recording sheet that bears the unfixed toner image; and a second fixing part that performs secondary fixation to the recording sheet fixed by the first fixing part, in which the second fixing part exists in the region just above the image forming part (refer to the dotted-line arrow(4) in FIG. 1). Alternatively, it is possible that the image forming part is provided with a belt-shape intermediate transfer member and that the second fixing part exists just above the intermediate transfer member.

Further, another aspect of the present invention relates to an image-forming apparatus that includes: an original reading part that reads an original to obtain image information; an image forming part that forms an unfixed toner image on a recording sheet in accordance with the image information; a first fixing part that performs primary fixation to the recording sheet that bears the unfixed toner image; and a second fixing part that performs secondary fixation to the recording sheet fixed by the first fixing part, in which the second fixing part exists in the region below the original reading part (refer to the dotted-line arrow(5) in FIG. 1). Alternatively, the second fixing part may exist in the region just above the image forming part and in the region just below the original reading part (refer to the dotted-line arrows(4)(5) in FIG. 1).

Further, according to another aspect of the present invention, at least a part of a conveying path for the recording sheet which leads to the second fixing part from the first fixing part exists above the image forming part (refer to the solid-line arrow(1) in FIG. 1). Preferably, at least a half of the conveying path for the recording sheet which leads to the second fixing part from the first fixing part exists above the image forming part. More preferably, the entire conveying path for the recording sheet which leads to the second fixing part from the first fixing part exists substantially above the image forming part.

Note that, according to another aspect of the present invention, when the positions (in a vertical direction) of the respective parts are considered, the positions mean, for example, the position (final transfer position) for forming the toner image on the recording sheet as to the image forming part, the position (fixing position) for fixing the recording sheet as to the first and second fixing parts, and the position (photoelectric conversion position) for reading an original to obtain image information as to the original reading part, respectively. Further, according to another aspect of the present invention, when the regions (in a vertical direction) of the respective parts are considered, the regions mean, for example: a latent image bearing member, a toner image bearing member, and the respective devices for respective electrophotographic processes (charging, exposure, developing, transfer, cleaning, and charge elimination) which are arranged in the periphery of the bearing members as to the image forming part; and a platen transparent body, a moving carriage, an illuminating lamp, and the like as to the original reading part, respectively.

Further, according to another aspect of the present invention (under the consideration with a focus on a relationship among the respective positions), it is possible that a conveying path for the recording sheet which leads to the first fixing part from a holding tray that holds the recording sheet has a vertical direction component larger than a horizontal direction component. Further, it is possible that the conveying path for the recording sheet which leads to the first fixing part from the holding tray that holds the recording sheet extends substantially in a vertical direction. A vertical component of a primary fixing line, which links the position at which the unfixed toner is formed on the recording sheet and the position at which the recording sheet is subjected to primary fixation, is larger than a horizontal component of the primary fixing line. For example, the primary fixing line, which links the position at which the unfixed toner is formed on the recording sheet and the position at which the recording sheet is subjected to primary fixation, may be substantially in a vertical direction.

Further, a vertical component of a secondary fixing line, which links the position at which the recording sheet is subjected to primary fixation and the position at which the recording sheet is subjected to secondary fixation, is smaller than a horizontal component of the secondary fixing line. For example, the secondary fixing line, which links the position at which the recording sheet is subjected to primary fixation and the position at which the recording sheet is subjected to secondary fixation, may be substantially in a horizontal direction.

Further, the ratio between the vertical component and the horizontal component of the primary fixing line, which links the position at which the unfixed toner is formed on the recording sheet and the position at which the recording sheet is subjected to primary fixation (vertical component/horizontal component) is larger than the ratio between the vertical component and the horizontal component of the secondary fixing line, which links the position at which the recording sheet is subjected to primary fixation and the position at which the recording sheet is subjected to secondary fixation (vertical component/horizontal component).

Further, it is possible that the recording sheet discharged from the second fixing part is discharged to a portion just above the image forming part. Alternatively, it is possible that the image forming part is provided with a belt-shape intermediate transfer member and that the recording sheet discharged from the second fixing part is discharged to a portion just above the intermediate transfer member.

With the image-forming apparatus structured as described above, saving of space and improvement in operability can be promoted in the image-forming apparatus.

Further, according to another aspect of the present invention, there is provided an image-forming apparatus that includes: an image forming main body unit that includes the image forming part and the first fixing part; and a secondary fixing unit which includes the second fixing part and which is detachable to the image forming main body unit. With the image-forming apparatus structured as described above, a high-gloss image can be obtained only by newly and additionally providing the secondary fixing unit to a conventional image forming main body unit (for general text and with low gloss or non-gloss), which leads to reduction in cost of development/production of the image-forming apparatus for a high-gloss image. Note that the present invention can also be recognized as the secondary fixing unit detachable to the image forming main body unit.

Further, according to another aspect of the present invention, an installation projected area of the entire image-forming apparatus in which the image forming main body unit is additionally provided with the secondary fixing unit (refer to S3 in FIG. 2(*b*-1) and S4 in FIG. 2 (*b*-2)) is smaller than the sum of an installation projected area of the single image forming main body unit (refer to S1 in FIG. 2(*a*)) and an installation projected area of the single secondary fixing unit (refer to S2 in FIG. 2(*a*)). Preferably, an installation projected area of the image-forming apparatus in which the image forming main body unit is additionally provided with the secondary fixing unit (refer to S4 in FIG. 2(*b-2*)) is (substantially) equal to an installation projected area of the image forming main body unit (refer to S1 in FIG. 2(*a*)).

Further, according to another aspect of the present invention, there is provided an image-forming apparatus that includes: an image forming main body unit that includes the image forming part and the first fixing part; and a post-processing unit which includes the second fixing part and which is detachable to the image forming main body unit. In this case, the post-processing unit may be provided with a cutting part that cuts the recording sheet that has undergone the secondary fixation to have a desired size. Further, an installation projected area of the entire image-forming apparatus in which the image forming main body unit is additionally provided with the post-processing unit is smaller than the sum of an installation projected area of the single image forming main body unit and an installation projected area of the single post-processing unit. Further, preferably, an installation projected area of the image-forming apparatus in which the image forming main body unit is additionally provided with the post-processing unit is equal to an installation projected area of the image forming main body unit.

On the other hand, the installation projected area of the image-forming apparatus in which the image forming main body unit is additionally provided with the post-processing unit may be larger than the installation projected area of the image forming main body unit in some cases. Even in such a case, in order to promote effective utilization of space as much as possible, it is preferable that the installation projected area of the image-forming apparatus in which the image forming main body unit is additionally provided with the post-processing unit is larger than the installation projected area of the image forming main body unit and that a peripheral device of the image-forming apparatus can be/is additionally provided just below a protruded portion of the post-processing unit with respect to the image forming main body unit. Note that examples of the peripheral device include a coin unit and a card unit.

Further, according to another aspect of the present invention, a size of the recording sheet that can be fixed with the second fixing part is smaller than a size of the recording sheet that can be fixed with the first fixing part. Preferably, the size of the recording sheet that can be fixed with the second fixing part is equal to or less than half the size of the recording sheet that can be fixed with the first fixing part. For example, the maximum size of the recording sheet that can be fixed with the second fixing part can be set to a postcard size or an L-size of a photograph, and the maximum size of the recording sheet that can be fixed with the first fixing part can be set to an A3 size. With the image-forming apparatus structured as described above, the second fixing device is reduced in size, and the above-described layout is easily adopted, as a result of which saving of space and improvement in operability can be promoted in the image-forming apparatus that outputs a high-gloss image.

Further, the small-size second fixing part contributes to saving power. Suppression of power consumption is highly needed in the image-forming apparatus that outputs a high-gloss image due to the following circumstances. In general, the image-forming apparatus that outputs a high-gloss image and outputs a non-gloss/low-gloss image often uses power of a commercial power source up to 1,500 W (100 V, 15 A) that corresponds to tolerance limits in order to secure productivity on standard paper (with a non-gloss/low gloss image). Here, when a heating source is further used as the second fixing part, and power is used for an image processing device for high image-quality and a drive/cooling fan of the second fixing device in order to perform high-gloss processing, the maximum power of the entire apparatus largely exceeds 1,500 W in the case where the first fixing part and the second fixing part are operated at the same time.

Supposedly in the case where two plug sockets of the commercial power source are prepared, an original power source has a circuit breaker of 20 A in the usage environment such as a general office, a bookstore or an appliance store. Thus, power consumption needs to be lowered to 2,000 W at the maximum. Large-scale power-source work is required for the usage environment in order to use power of 2,000 W or more. Note that control is made such that the heating sources of the first fixing part and the second fixing part are not turned on simultaneously, whereby saving power is further promoted.

According to another aspect of the present invention, the image-forming apparatus further includes a control part that selects a first fixing mode that performs primary fixation to the recording sheet only with the first fixing part or a second fixing mode that performs primary fixation and secondary fixation to the recording sheet with the first fixing part and the second fixing part. With the image-forming apparatus structured as described above, a relatively low-gloss image can be output in the first fixing mode, and a high-gloss image can be output in the second fixing mode. Thus, both the low-gloss image output and the high-gloss image output can be performed with the single image-forming apparatus, which contributes to saving of space. Further, since the recording sheet is conveyed to the second fixing part after the fixation with the first fixing part, an image defect is difficult to occur even if the direction of the conveying path for the recording sheet is bent on the midway. As a result, a vacuum conveying device or the like is not required, which leads to reduction in cost of development/production.

Further, from the viewpoint of space saving, it is preferable in the image-forming apparatus that the recording sheet that has undergone fixation in the first fixing mode and the recording sheet that has undergone fixation in the second fixing mode are both discharged to a portion above the image forming part; that the recording sheet that has undergone fixation in the first fixing mode and the recording sheet that has undergone fixation in the second fixing mode are both discharged to a portion just above the image forming part; and that a conveying path for the recording sheet in the first fixing mode exists above or below the second fixing part.

Note that, the image-forming apparatus can be adopted in which: the second fixing part includes: a heating roll provided with a heating source; at least one tension roll; an endless belt tensioned around the heating roll and the tension roll; and a pressure roll that faces the heating roll while sandwiching the endless belt there between; and the recording sheet is pressurized at a nip portion formed by the endless belt and the pressure roll to be adhered to a surface of the endless belt, and is peeled form the surface of the endless belt after conveyance of the recording sheet. Alternatively, the second fixing part may have a cooling member which contacts with the back surface of the endless belt on which the recording sheet is conveyed in the state of being adhered thereto and which cools the recording sheet through the endless belt. For example, a heat sink that contacts with the back surface of the endless belt is given as the cooling member, and a fan member for sending air to the heat sink may be used at the same time.

Further, it is preferable that the recording sheet subjected to the secondary fixation with the second fixing part has a thermoplastic resin layer at least on its surface that bears the toner image. Note that it is preferable that the thermoplastic resin layer is selected to be made of the same material as that of toner resin constituting the toner image so that the melting temperature is substantially the same between both the resins.

From the above, according to the present invention, an image-forming apparatus can be provided which can output a high-gloss image and which is small in size and excellent in operability.

BRIEF DESCRIPTION OF THE DRAWINGS

Preferred embodiments of the present invention will be described in detail based on the following figures, wherein.

DETAILED DESCRIPTION OF THE PREFERRED EMBODIMENTS

Embodiment 1

Figure 1:
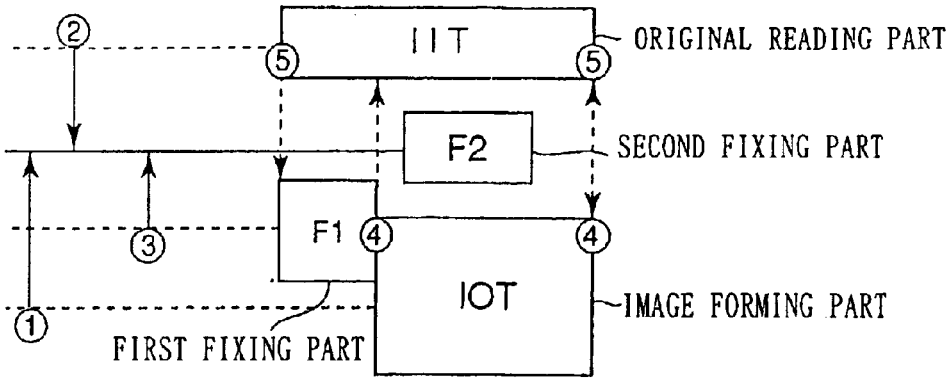
FIG. 1 illustrates the concept of the present invention from a point of view.
Figure 2:
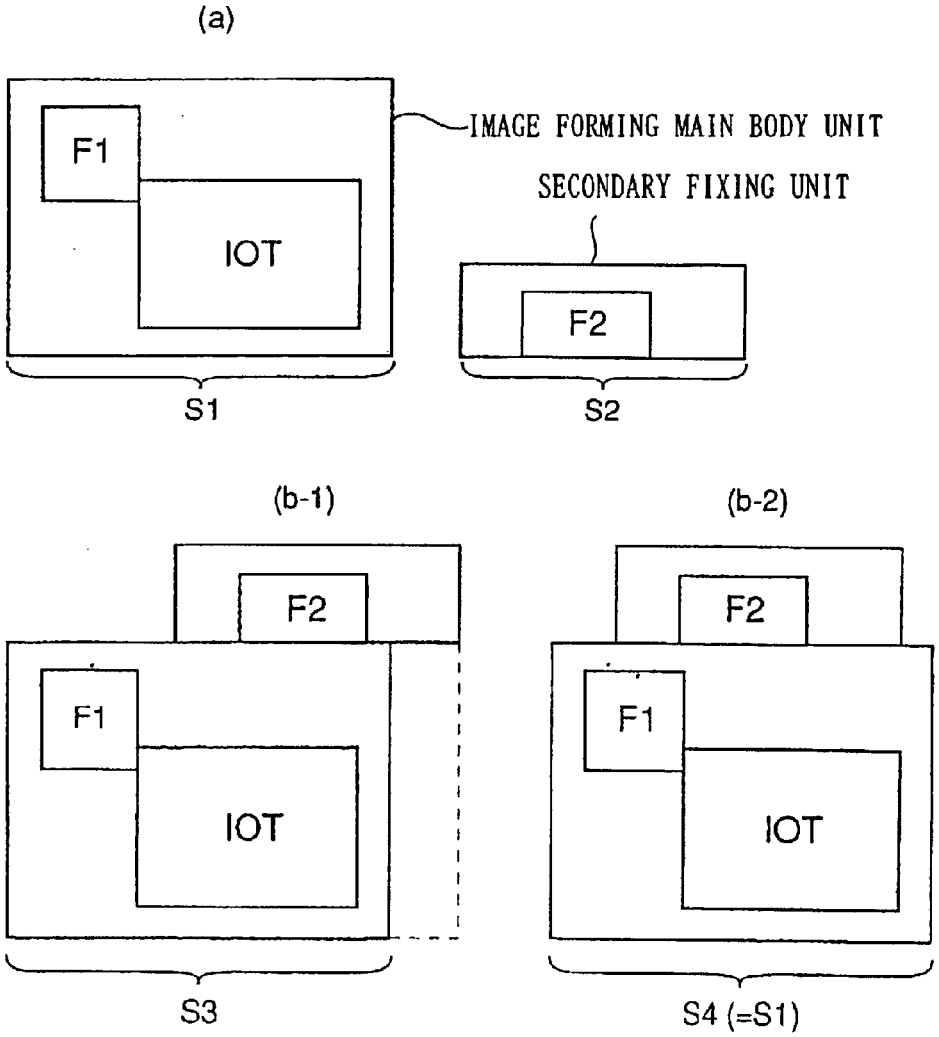
FIG. 2 illustrates the concept of the present invention from another point of view.
Figure 3:
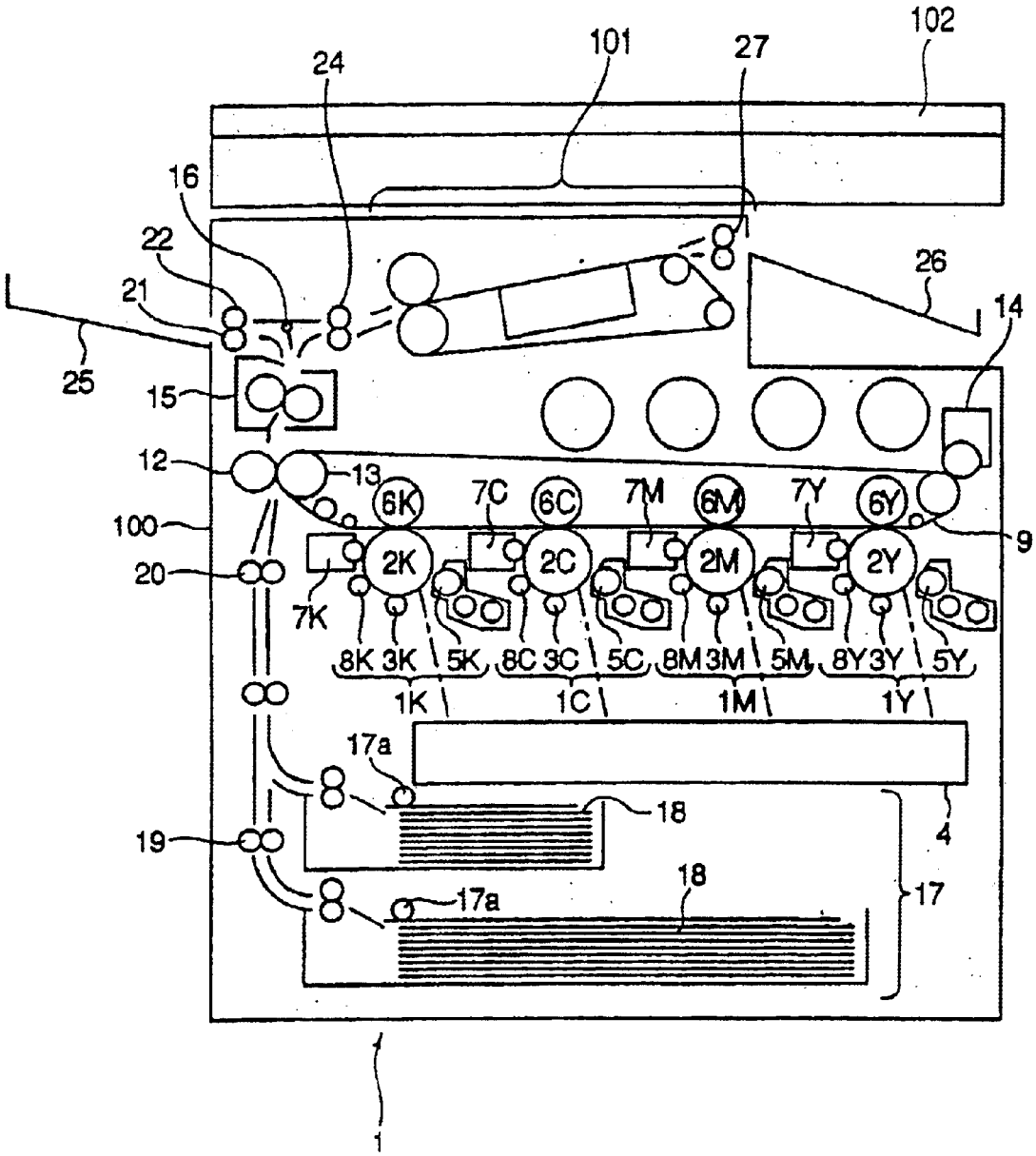
FIG. 3 is a schematic sectional view of an image-forming apparatus according to Embodiment 1 of the present invention.

FIG. 3 is a schematic structural view of a tandem color copying machine (image-forming apparatus) 1 according to this embodiment. The copying machine 1 is composed of an apparatus main body 100 and an image reading device (original reading part) 102. An image output section and a second fixing device (second fixing part) 101 are built in the apparatus main body 100. The image output section is composed of a first fixing device (first fixing part) 15 and an image forming section (image forming part).

The image forming section is provided with: an endless intermediate transfer belt 9 that is tensioned and rotated about plural tension rolls; electrophotographic image forming units 1Y, 1M, 1C, and 1K that form toner images of respective colors of yellow, magenta, cyan, and black, the units being arranged from the upstream side to the downstream side in a rotational direction of the intermediate transfer belt 9; a belt cleaning device 14 that faces the intermediate transfer belt 9; a secondary transfer roll 12 that also faces the intermediate transfer belt 9; a paper tray 17 that separately holds standard paper (recording sheet) 18 (S) and dedicated glossy paper (recording sheet) 18 (P); a pickup roll 17*a*; pairs of conveying rolls 19, 24; a pair of registration rolls 20; a pair of first discharge rolls 22; a first discharge tray 25; a pair of second discharge rolls 27; a second discharge tray 26; and the like.

The electrophotographic image forming units 1Y, 1M, 1C, and 1K are each provided with a photosensitive drum 2, a charging roll 3, a developing device 5, a primary transfer roll 6, a drum cleaning device 7, an antistatic roll 8, and the like.

Figure 4:
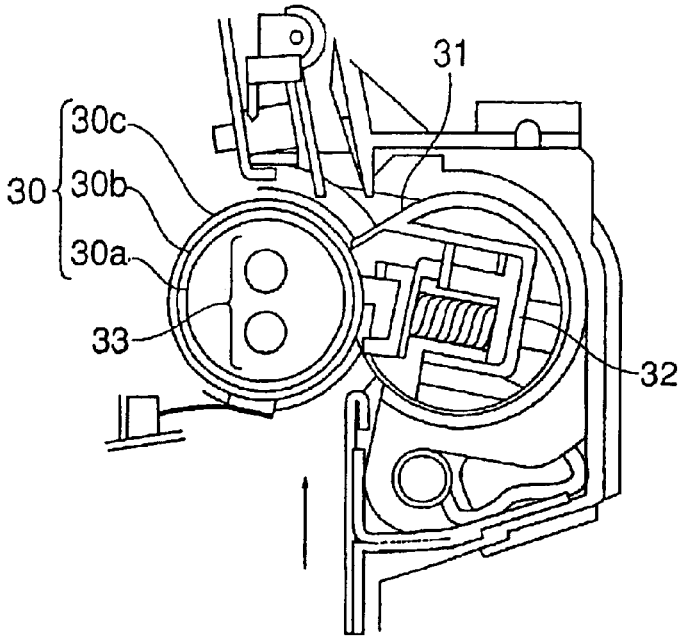
FIG. 4 is a schematic sectional view of a first fixing device.

FIG. 4 illustrates a structure of the first fixing device 15. The first fixing device 15 is a pressure belt fixing device composed of a fixing roll 30 with a small heat capacity, a pressure belt 31, and a pressure pad 32. The fixing roll 30 is formed by covering a surface of a core 30*a*, which is formed of aluminum, with a thickness of 1.5 mm, an outer diameter of 25 mm, and a length of 380 mm with an elastic body layer 30*b*, which is formed of silicone rubber with rubber hardness (JIS-A) of 33°, with a thickness of 0.5 mm and a length of 320 mm and further covering a surface of the elastic body layer 30*b* with a release layer 30*c* formed of a PFA tube with a thickness of 30 $\mu$m. A halogen lamp 33 with 650 W as a heating source is arranged in the fixing roll 30, and heating is performed from the inside of the fixing roll 30 such that the surface temperature rises to a predetermined temperature (170° C.).

The pressure belt 31 is formed by forming a release layer, which is formed of a PFA tube, with a thickness of 30 $\mu$m on a surface of a polyimide belt with a thickness of 75 $\mu$m, an outer diameter of 30 mm, and a length of 330 mm. Arranged inside the pressure belt 31 is the pressure pad 32 that presses the pressure belt 31 against the fixing roll 30 to form a nip therebetween. The pressure pad 32 has a pressure load of 33 Kg and a nip width of 6.5 mm. A heat source is not provided on the side of the pressure belt 31/pressure pad 32.

Figure 5:
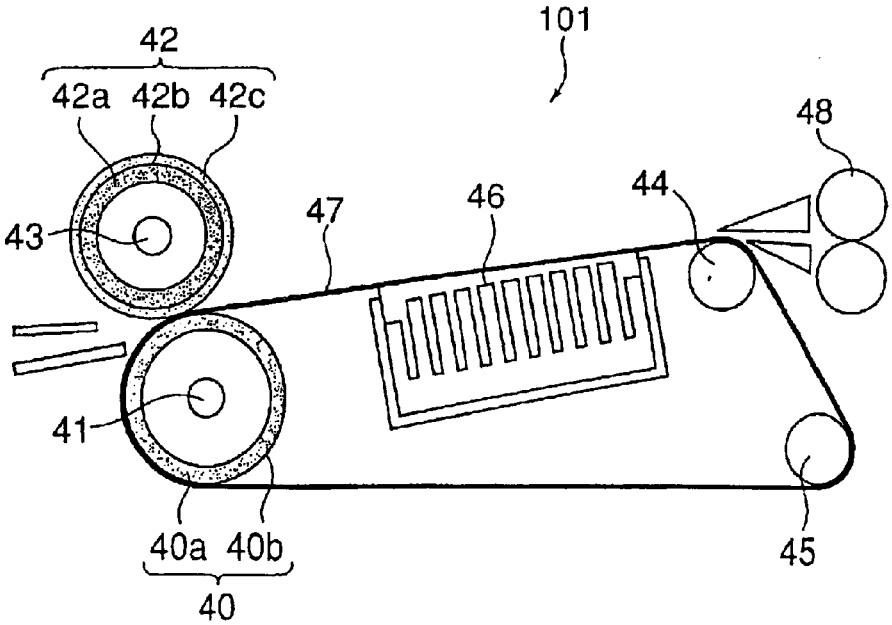
FIG. 5 is a schematic sectional view of a second fixing device.

FIG. 5 illustrates the structure of the second fixing device 101. The second fixing device 101 includes: a heat fixing roll (heating roll) 40 having a heat source; a peeling roll (tension roll) 44; a steering roll (tension roll) 45; a fixing belt (endless belt) 47 that is wound around the heat fixing roll 40, the peeling roll 44, and the steering roll 45; a pressure roll 42 that presses the heat fixing roll 40 through the fixing belt 47 to form a nip; and a cooling device (cooling section) 46 that cools the fixing belt 47 on the downstream side of the nip in a rotational direction of the fixing belt 47. Also, the second fixing device 101 is a belt fixing device in which: the recording sheet 18 that bears toner is carried to the nip portion while a toner image contacts with the fixing belt 47, and then is fixed by heating and pressurization; and the fixing belt 47 and the recording sheet 18 are cooled by the cooling device 46 to be peeled.

The heat fixing roll 40 is formed by a release layer 40*b* made of a fluororesin layer, for example, a PFA tube on a surface of a core 40*a* made of metal with high thermal conductivity. Provided in the core 40*a* is a heating source 41 such as a halogen lamp, which is heated to set a surface temperature of the heat fixing roll 40 at a predetermined temperature and which heats the fixing belt 47 and the recording sheet 18 formed with the toner image. The pressure roll 42 is formed by covering a core 42*a* made of metal with high thermal conductivity with an elastic body layer 42*b* made of, for example, silicone rubber with rubber hardness (JIS-A) of about 40° and further by forming thereon a release layer 42*c* made of a fluororesin layer, for example, a PFA tube. Provided in the core 42*a* is a heating source 43 such as a halogen lamp, which is heated to set a surface temperature of the pressure roll 42 at a predetermined temperature and which applies pressure to the recording sheet 18 at the time of fixation and simultaneously heats the recording sheet 18 from the back surface side. The structures of the heat fixing roll 40 and the pressure roll 42 are not limited to the above ones. Any structure may be adopted as long as the toner image formed on the recording sheet 18 can be fixed onto the recording sheet 18 through the fixing belt 47.

The peeling roll 44 peels the recording sheet 18 from the fixing belt 47 due to rigidity of the recording sheet 18 itself, and its outer diameter shape (dimension) is determined by an attaching force of the fixing belt 47 and the recording sheet 18 and a winding angle of the fixing belt 47 with respect to the peeling roll 44. The steering roll 45 prevents breakage of an end portion of the belt due to deviation that occurs due to rotation of the fixing belt 47. One of axes of the steering roll 45 is fixed while the other axis is tiled with respect to the heat fixing roll 40 by a drive device (not shown), whereby the steering roll 45 plays a part of switching a travelling direction of the belt to the opposite direction in the case where the fixing belt 47 is deviated.

The cooling device 46 is for cooling the recording sheet 18 in close contact with the fixing belt 47, and is arranged on the inner circumferential surface of the fixing belt 47 and on the downstream side of the heat fixing roll 40 and the upstream side of the peeling roll 44. The cooling device 46 has a function of cooling the toner image and a transparent resin layer 18*a* as a surface of the recording sheet 18 which is melted by the heat fixing roll 40 and the pressure roll 42 and hardening the whole image surface in the state of being level with the surface of the fixing belt 47.

The fixing belt 47 is formed by covering an endless film made of thermosetting polyimide with, for example, a silicone rubber layer with a thickness of 35 $\mu$m. A thin belt is desired in terms of power consumption. However, the polyimide base material needs to have a thickness of 75 $\mu$m or more from the viewpoint of strength, and the silicone rubber layer needs to have a thickness of 30 $\mu$m or more from the viewpoint of image quality. Further, the fixing belt 47 is looped around the heat fixing roll 40, the peeling roll 44, and the steering roll 45, and rotates while following the heat fixing roll 40.

Here, the second fixing device 101 exists below the image reading device 102, exists above the image forming section (for example, a secondary transfer position) and just above the intermediate transfer belt 9, and exists above the first fixing device 15 but does not exist just thereabove. Also, the second fixing device 101 exists in the region just above the image forming section (for example, the intermediate transfer belt 9) and exists in the region just below the image reading device 102.

Figure 6:
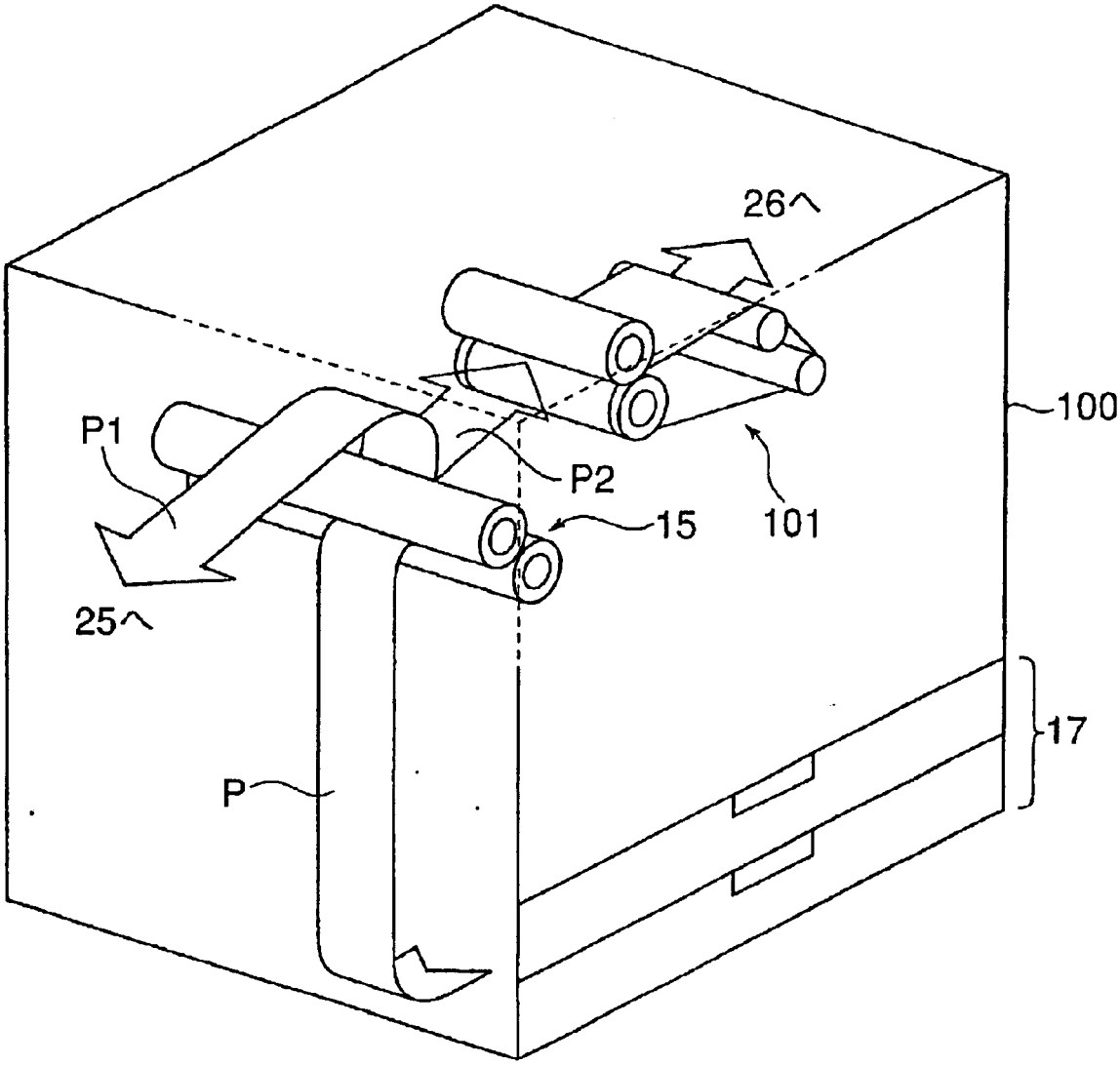
FIG. 6 is a perspective view for explaining a conveying path for a recording sheet of the image-forming apparatus according to Embodiment 1 of the present invention.

FIG. 6 illustrates a conveying path of the recording sheet 18 of the color copying machine 1 according to this embodiment. A conveying path P2 for the recording sheet 18 which leads to the second discharge tray 26 from the first fixing device 15 via the second fixing device 101 exists in the region just above the image forming section (for example, the intermediate transfer belt 9). On the other hand, a conveying path P1 for the recording sheet 18 which leads to the first discharge tray from the first fixing device 15 does not exist in the region just above the image forming section. Further, a conveying path P for the recording sheet 18 that leads to the first fixing device 15 from the paper tray 17 extends substantially in a vertical direction.

Further, a vertical component of a primary fixing line, which links the secondary transfer position and a primary fixing position, is substantially in a vertical direction. Moreover, a vertical component of a secondary fixing line, which links the primary fixing position and a secondary fixing position, is smaller than a horizontal component of the secondary fixing line. In addition, the recording sheet 18 discharged from the second fixing device 101 is discharged in the region just above the image forming section (for example, the intermediate transfer belt 9).

The layout described above is adopted, whereby first, saving of space (particularly in terms of installation area) of the entire apparatus 1 is promoted although the second fixing device 101 is provided, and second, operability of the apparatus 1 is excellent because the recording sheet 18 is discharged at a relatively high position.

Figure 7:
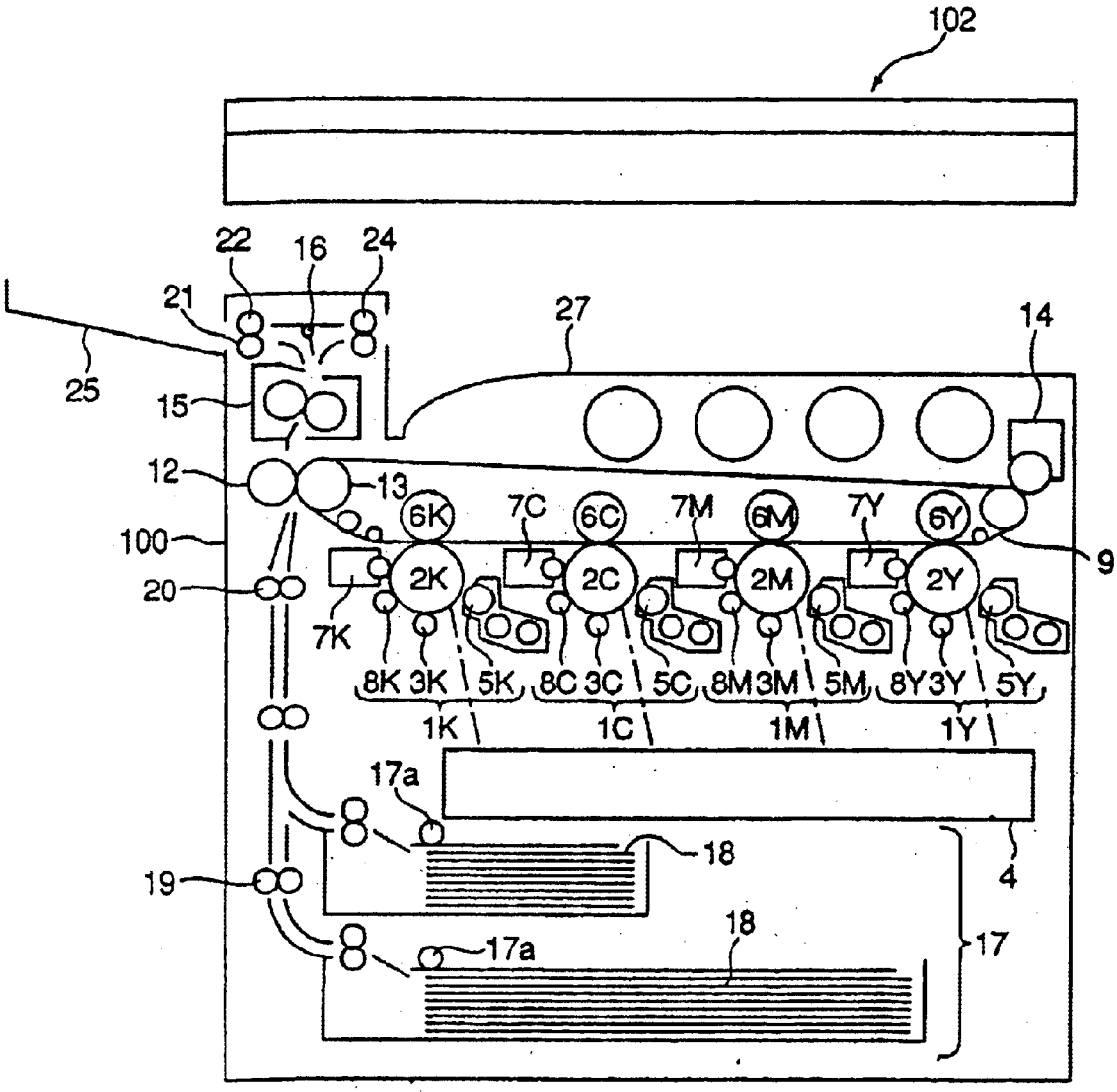
Fig 7 (Related Art)
FIG. 7 is a schematic sectional view of an image-forming apparatus in accordance with a comparison example.

FIG. 7 shows a conventional color copying machine (comparison example) having substantially the same structure as that of the color copying machine 1 according to this embodiment. Note that the same structural components are denoted by the same reference symbols between both the copying machines, and description thereof is omitted here. Under the comparison between the color copying machine 1 in this embodiment and the color copying machine in the comparison example, the color copying machine 1 in this embodiment has substantially the same size as the conventional color copying machine in the comparison example.

Next, an image forming operation with the color copying machine 1 in this embodiment is described separately for a normal print mode (first fixing mode) and a high-gloss print mode (second fixing mode).

Figure 8:
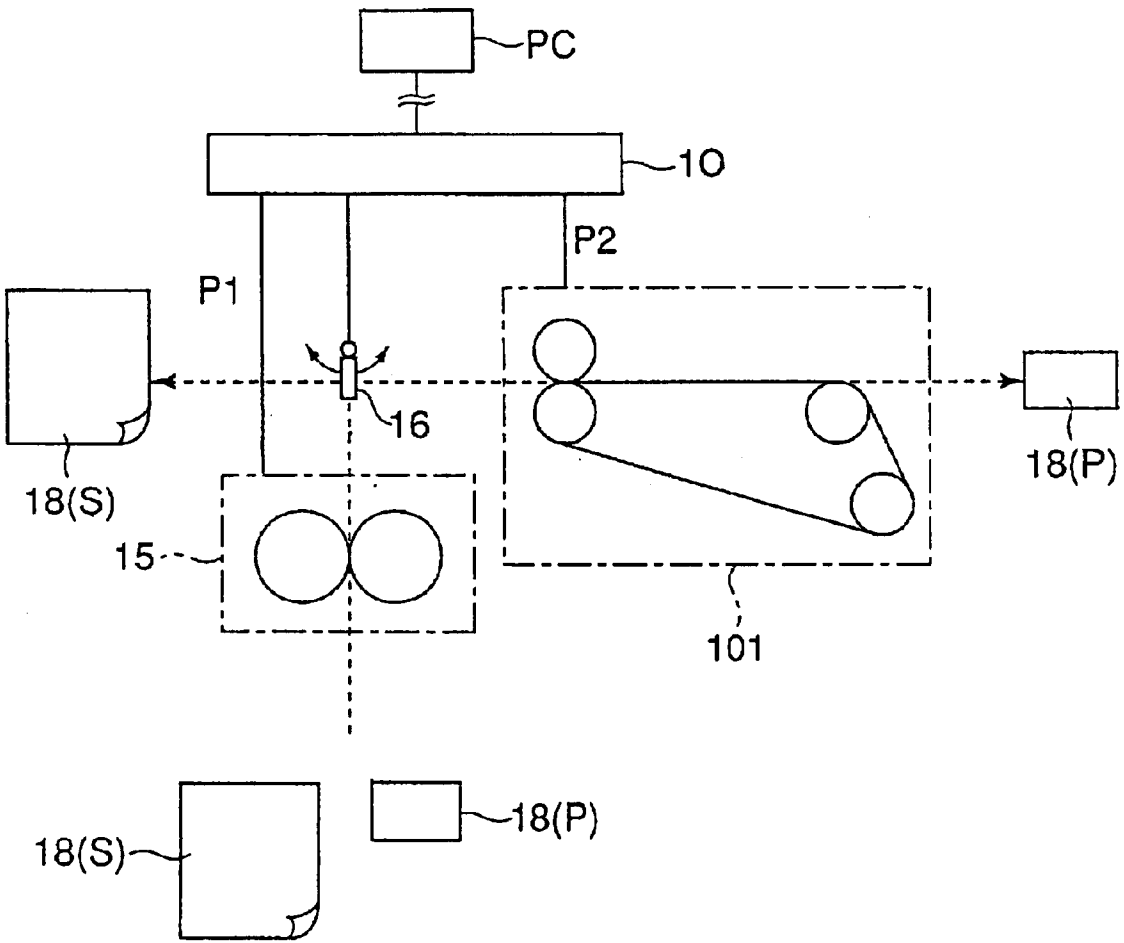
FIG. 8 is a block diagram for explaining a control system of the image-forming apparatus according to Embodiment 1 of the present invention.

FIG. 8 is a block diagram for illustrating a control system for controlling the respective print modes. The control system is configured with a control unit 10 of the color copying machine 1 being centered. Measurement objects of the control unit 10 include a control command signal from a personal computer PC connected to the copying machine 1 or from a not-shown user interface of the copying machine 1, a temperature signal from a not-shown temperature sensor of the first fixing device 15, and a temperature signal from a not-shown temperature sensor of the second fixing device 101. Further, control objects of the control unit 10 include a control command signal of a conveying direction switching gate 16, a power P1 supplied to the heating source of the first fixing device 15, and a power P2 supplied to the heating source of the second fixing device 101.

Normal Print Mode

To begin with, an image output in the normal print mode is described. When color image information transmitted from the personal computer PC or the like, color image information of a color original read by the image reading device 102, or the like is input, image processing is performed to the input image information.

First, description is made of the operation of forming a monochromatic toner image on the intermediate transfer belt 9 with a representative of the electrophotographic image forming unit 1Y. A surface of a photosensitive drum 2Y is uniformly charged with negative polarity by a uniform charging roll 3Y. Next, image exposure corresponding to a yellow image is performed (based on the image information that is previously subjected to image processing) by an exposing device 4 so that an electrostatic latent image corresponding to the yellow image is formed on the surface of the photosensitive drum 2Y. The electrostatic latent image corresponding to the yellow image becomes an yellow toner image by a developing device 5Y, and the yellow toner image is transferred onto the intermediate transfer belt 9 due to a press-contact force and electrostatic attraction of a primary transfer roll 6Y that constitutes a part of a primary transfer part. The yellow toner remaining on the photosensitive drum 2Y after transfer is scraped off by a drum cleaning device 7Y. After charge is eliminated from the surface of the photosensitive drum 2Y by an antistatic roll 8Y, the surface is again charged by the uniform charging roll 3Y for the next image forming cycle.

In the color copying machine 1 that performs multi-color image formation, the same image forming process as described above is also performed in each of the electrophotographic image forming units 1M, 1C, and 1K at the timing with the consideration of relative positional deviation among the electrophotographic image forming units 1Y, 1M, 1C, and 1K, and a full-color toner image is formed on the intermediate transfer belt 9.

The full-color toner image formed on the intermediate transfer belt 9 is transferred onto the recording sheet 18 conveyed to the secondary transfer position at a predetermined timing due to a press-contact force and electrostatic attraction of a backup roll 13 that supports the intermediate transfer belt 9 and the secondary transfer roll 12 which is in press contact with the backup roll 13 and which constitutes a part of a secondary transfer part.

The recording sheet 18 with a predetermined size is fed by the feed roll 17*a* from the sheet feeding cassette 17 serving as a recording medium holding section arranged in the lower portion of the color copying machine 1. Here, in the normal print mode, the standard paper 18 (S) is fed as the recording sheet 18. The fed recording sheet 18 is conveyed to the secondary transfer position of the intermediate transfer belt 9 at a predetermined timing by means of the plural conveying rolls 19 and registration rolls 20. Then, as described above, the full-color toner image is collectively transferred from the intermediate transfer belt 9 onto the recording sheet 18 by means of the backup roll 13 as the secondary transfer part and the secondary transfer roll 12.

Further, the recording sheet 18 on which the full-color toner image has been transferred from the intermediate transfer belt 9 is separated from the intermediate transfer belt 9 and then is conveyed to the first fixing device 15 arranged above the secondary transfer part. The toner image is primarily fixed onto the recording sheet 18 with heat and pressure by the first fixing device 15. Further, the residual toner on the intermediate transfer belt 9 which has not been transferred onto the recording sheet 18 by the secondary transfer part is conveyed as it is to the intermediate transfer member cleaning device 14 in the state of being on the intermediate transfer belt 9, and is removed from the intermediate transfer belt 9 by the cleaning part 14.

In the normal print mode, the direction of the conveying direction switching gate 16 is controlled by the control unit 10 so that the conveying direction is switched to the direction toward a first recording medium discharge port 21, and the sheet is discharged with the image forming surface facing upwardly on the discharge tray 25 for a standard paper mode by the discharge rolls 22.

High-Gloss Print Mode

Figure 9:
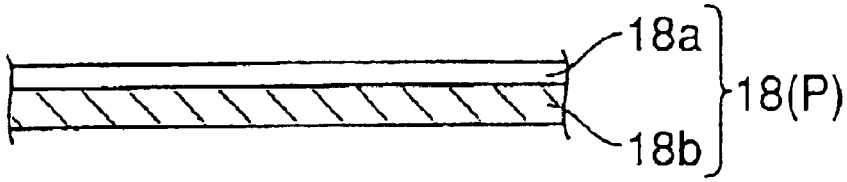
FIG. 9 is a schematic sectional view for explaining a dedicated glossy paper used in a high-gloss print mode.

Next, an image output in the high-gloss print mode is described with a focus on a different point from that in the normal print mode. Input of image information, image processing, and formation of a full-color toner image on the intermediate transfer belt 9 are performed in the same manner as in the normal print mode. On the other hand, when the recording sheet 18 with a predetermined size is fed by the feed roll 17*a* from the sheet feeding cassette 17, the dedicated glossy paper 18 (P) is fed as the recording sheet 18 in the high-gloss print mode. The dedicated glossy paper 18 (P) is formed by providing a transparent image-receiving layer (transparent resin layer) 18*a* with a thickness in a range of 5 to 20 $\mu$m, for example, 10 $\mu$m which contains as a main constituent thermoplastic resin made of polyester or the like on one side (surface) of a paper base material 18*b* as shown in FIG. 9.

As to the fed recording sheet 18, the full-color toner image is collectively subjected to secondary transfer to undergo primary fixation in the same manner as in the normal print mode. Here, in the high-gloss print mode, the direction of the conveying direction switching gate 16 is controlled by the control unit 10 so that the conveying direction is switched to the direction toward the second fixing device 101, and the recording sheet 18 is conveyed to the second fixing device 101 side by the conveying rolls 24 (refer to FIG. 3).

Figure 10:
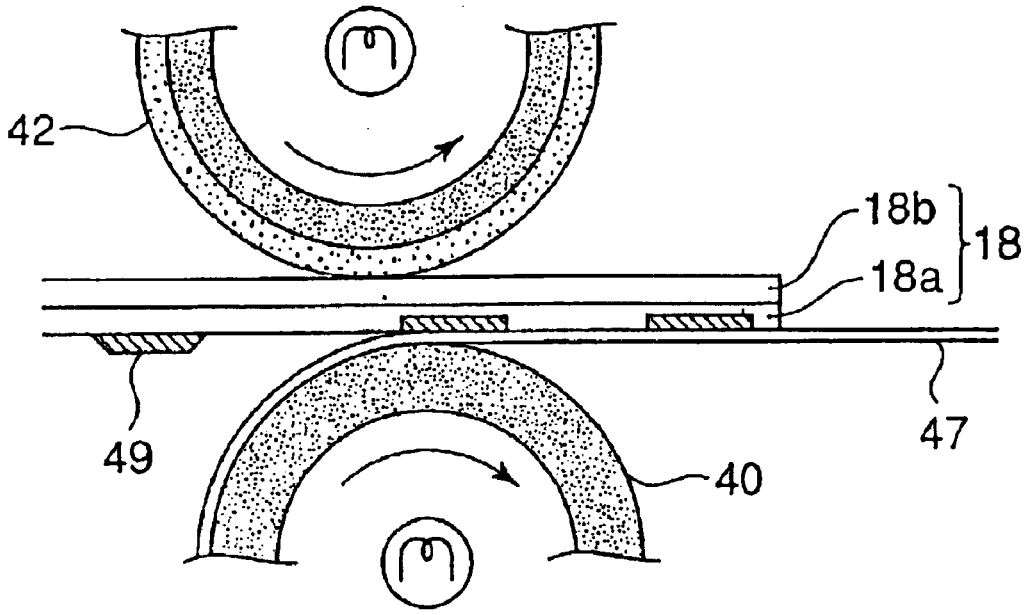
FIG. 10 illustrates secondary fixation in a second fixing device.

FIG. 10 illustrates a secondary fixing operation of the second fixing device 101. As shown in the same figure, a toner 49 on the recording sheet 18 is embedded into the transparent resin layer 18*a* as the surface of the dedicated glossy paper 18 (P) by the fixing belt 47 wound around the heat fixing roll 40 and the pressure roll 42 in the second fixing device 101. The recording sheet 18 is conveyed in the state of being in close contact with the fixing belt 47, is cooled at a predetermined temperature by the cooling device 46, and then is peeled from the fixing belt 47 by the peeling roll 44. Thereafter, the recording sheet 18 is discharged with the image forming surface facing downwardly on the discharge tray 26 for the high-gloss print mode by discharge rolls 48.

Here, the toner 49 on the recording sheet 18 to be conveyed to the second fixing device 101 has already undergone fixation once by means of the first fixing device 15 arranged in the image-forming apparatus 100. Thus, when the conveying direction switching operation is conducted with the conveying direction switching gate 16, an image-quality defect such as image distortion does not develop even in the case where the image forming surface contacts with a conveyance supporting member or the like.

Further, the color copying machine 1 is provided with the normal print mode for performing a low-gloss image output only with the primary fixation and the high-gloss print mode for performing a high-gloss image output with both the primary fixation and the secondary fixation. Thus, saving of space can be promoted (in comparison with the case where image-forming apparatuses are provided respectively for the two modes).

Furthermore, the second fixing device 101 in this embodiment takes the following structures in order to attain reduction in power consumption and reduction in size, (and, as a result,) improvement in operability of the color copying machine 1. Hereinafter the structures are described as Modification Examples 1 and 2.

MODIFICATION EXAMPLE 1

In this modification example, the maximum size of the recording sheet 18 that can be fixed with the second fixing device 101 is set smaller than the maximum size of the recording sheet that can be fixed with the first fixing device 15. That is, it is set that the high-gloss print mode cannot be selected with respect to the recording sheet 18 having a size equal to or larger than a given size in accordance with a control program of the control unit 10.

Figure 11:
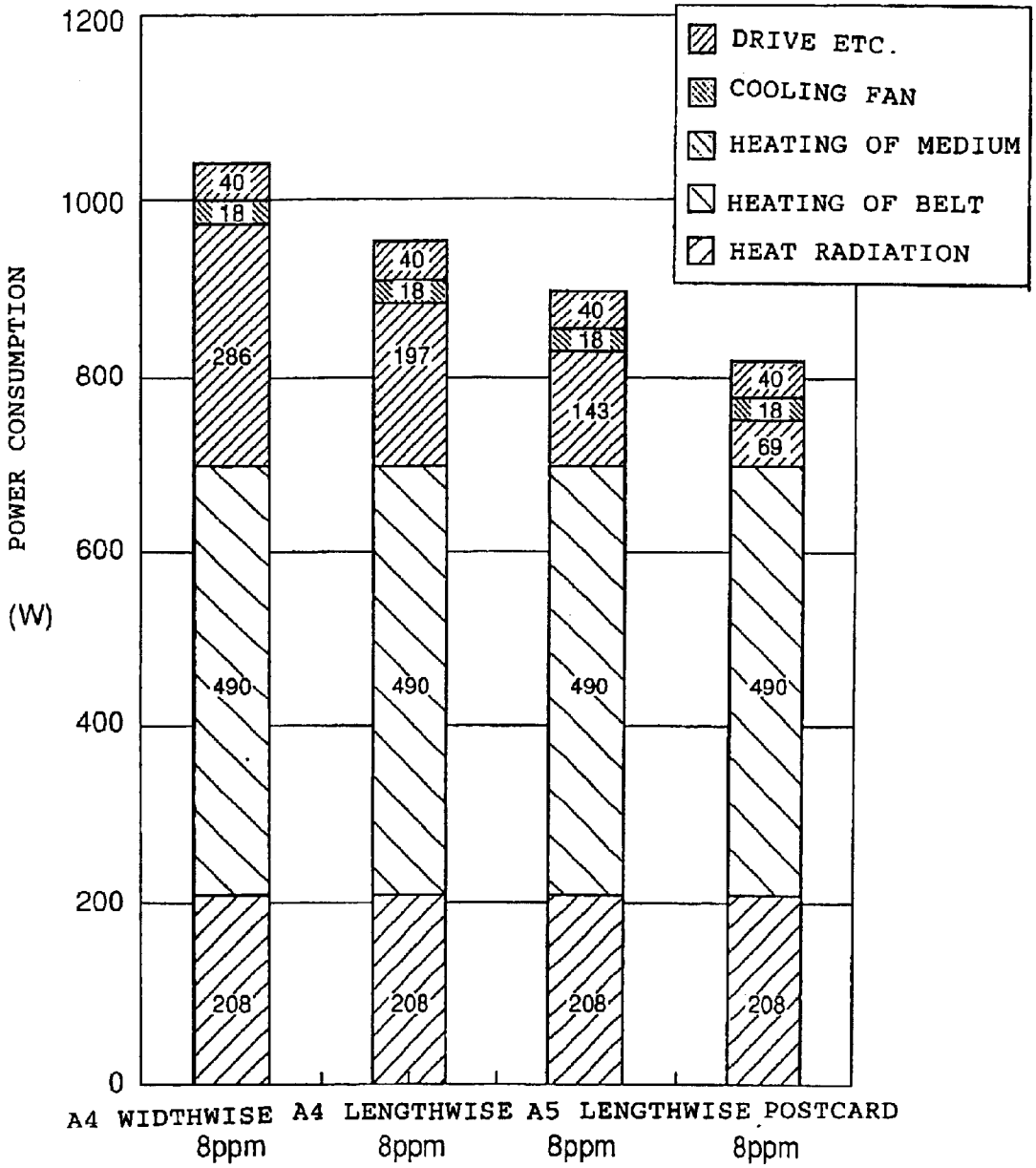
FIG. 11 is a bar graph for explaining the relationship between size of a recording sheet and power consumption of the second fixing device.

FIG. 11 is a bar graph for explaining the relationship between the size of the recording sheet 18 that can be fixed with the second fixing device 101 and the power consumption of the second fixing device 101. As shown in this graph, in the second fixing device 101, power consumption is very large since the cycle of heating and cooling the recording sheet 18 is repeated with the fixing belt 47. When the recording sheet 18 is subjected to A4 long-edge feed (LEF): 8 ppm, power of approximately 1,000 W is required only for the second fixing device 101. In addition, power of 1,500 W is required for the image-forming apparatus 100 including the first fixing device 15. As a result, power of 2,000 W or more in total is required.

In view of the above, the size of the recording sheet 18 output by the second fixing device 101 is limited to a postcard or an L-size photograph for which an image with high gloss and high smoothness is required. As a result, the total power consumption of the second fixing device 101 is about 800 W, and power consumption of about 200 W can be reduced.

MODIFICATION EXAMPLE 2

In this modification example, the length in a rotation-axis direction (of, for example, the fixing belt 47) of the second fixing device 101 is set shorter than the length in a rotation-axis direction (of, for example, the fixing roll 30) of the first fixing part 15.

Figure 12:
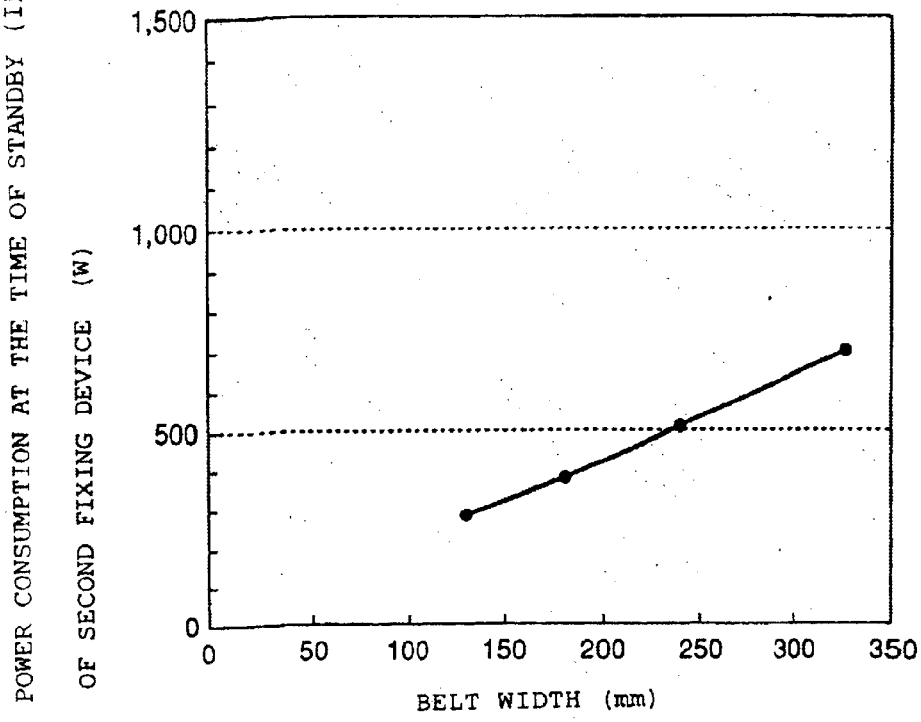
FIG. 12 is a graph for explaining the relationship between width of a fixing belt and power consumption at the time of standby of the second fixing device.
Figure 13:
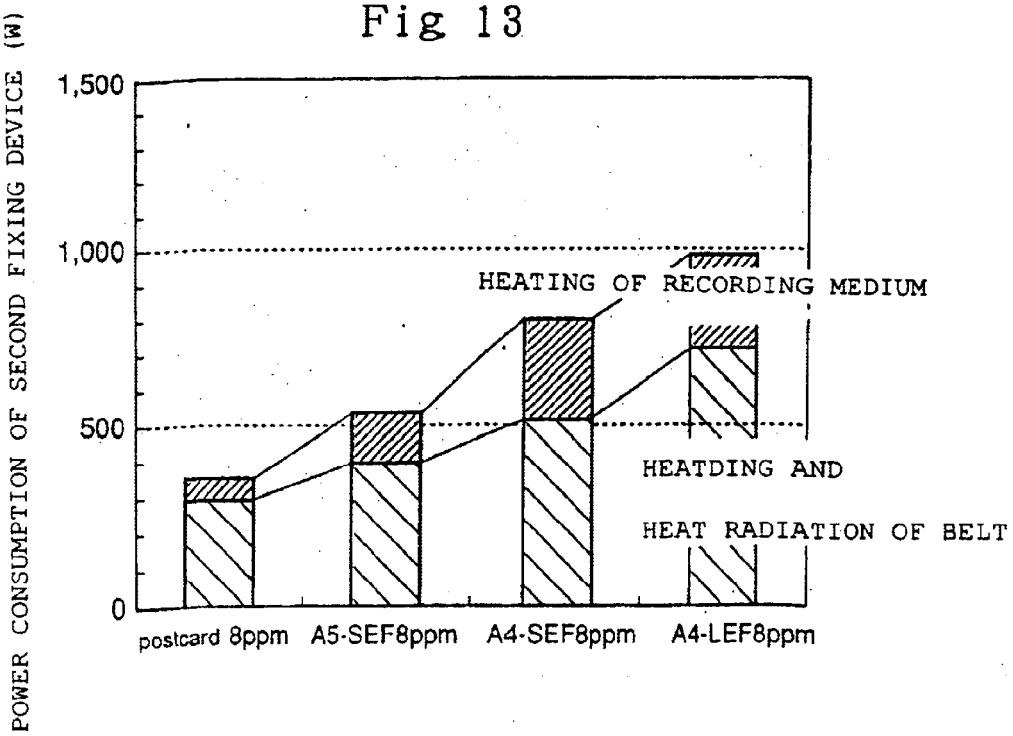
FIG. 13 shows power consumption of the second fixing device necessary for the case where a recording medium with the maximum size which is adapted for the width of the fixing belt.

FIG. 12 is a graph for explaining the relationship between the length (width) in the rotation-axis direction of the fixing belt 47 and the power consumption at the time of standby (idling) of the second fixing device 101. Further, FIG. 13 is a graph for explaining the power consumption of the second fixing device 101 necessary for the case where the recording medium with the maximum size adapted for the width of the fixing belt 47 of the second fixing device 101 is fixed. As apparent from these graphs, it is found that the power consumption is proportional to the width of the fixing belt 47 and that the power consumption is largely influenced by power loss caused by the fixing belt 47.

Then, the second fixing device 101 is used with which the size of the recording sheet 18 output in a photographic mode is limited to a postcard or an L-size photograph for which an image with high gloss and high smoothness is required, that is, the lengths in the rotation-axis direction of the heat fixing roll 40, the pressure roll 42, and the fixing belt 47 with large loss in power consumption are shortened to the length (about 165 mm) at which the L-size sheet can be fixed. Thus, the power consumption of the second fixing device 101 can be suppressed to 380 W.

TABLE 1

| | | A4 Long-Edge Feed (LEF) | | Postcard | |
|---|---|---|---|---|---|
| | | Fixing and Heating Roll | Pressure Roll | Fixing and Heating Roll | Pressure Roll |
| Roll Structure | Outer Diameter | ϕA mm | ϕA mm | ϕ0.7A mm | ϕ0.7A mm |
| | Elastic Layer Thickness | None | B mm | None | B mm |
| | Core Thickness | C mm | C mm | 1.5C mm | 0.5C mm |
| | Length | D mm | D mm | 0.5D mm | 0.5D mm |
| | Nip Width | E mm | | E mm | |
| Deflection | Setting Load | F kgf | | 0.5F kgf | |
| | Deflection Amount | 43.6 μm | 56.8 μm | 6.5 μm | 22.1 μm |

In Table 1, the set values on the roll structure and on the deflection amount are shown for both the case where the length in the axial direction of the second fixing device 101 is adapted for the A4 size long-edge feed and the case where the length is adapted for the postcard size. Note that reference symbols A, B, C, D, E, and F are all certain set values in Table 1.

As shown in Table 1, the length in the axial direction of the second fixing device 101 is shortened, whereby reduction in diameter (reduction by about 30 percent) can be attained in the heat fixing roll and the pressure roll without influence on fixing characteristics (image quality). Further, reduction in pressure setting load (reduction by about 50 percent) can be attained, and reduction in size can be attained in a pressure structure member as a strength member and components that constitute the second fixing device 101. The reduction in diameter in the heat fixing roll 40 and the pressure roll 42 and the reduction in size in the structural components due to the reduction in pressure setting load enable reduction in size and in thickness by about 30 percent of the second fixing device 101.

MODIFICATION EXAMPLE 3

In this modification example, the control program of the control unit 10 is set such that power is not supplied simultaneously to the halogen lamp 33 as the heating source of the first fixing device 15 and the halogen lamps 41 and 43 as the heating sources of the second fixing device 101 (refer to FIG. 8). That is, it is set that the control unit 10 supplies power to the heating source of either the first fixing device 15 or the second fixing device 101 even in the case where the temperature of the first fixing device 15 is less than the set temperature and at the same time, the temperature of the second fixing device 101 is less than the set temperature (P1 or P2). At this time, it is preferable that power is supplied only to the heating source of the fixing device with a smaller heat capacity (the first fixing device 15 in this example).

In accordance with the measures taken in Modification Examples 1 to 3, power consumption of the second fixing device 101 is reduced, and ON/OFF control, operational timing control, and the like are performed such that the heating sources are not turned on simultaneously. As a result, power consumption of the image-forming apparatus 100 and the second fixing device 101 is reduced to 1,500 W or less, and thus, the color copying machine can be used in the usage environment (power-source environment) such as a general office/convenience store. Further, the reduction in size and in thickness of the second fixing device 101 prevents the height in arrangement of the image reading device 102 from increasing even in the case where the second fixing device 101 is arranged in the upper portion of the image-forming apparatus 100, which does not exert influence on the operability of the image reading device 102.

Embodiment 2

Figure 14:
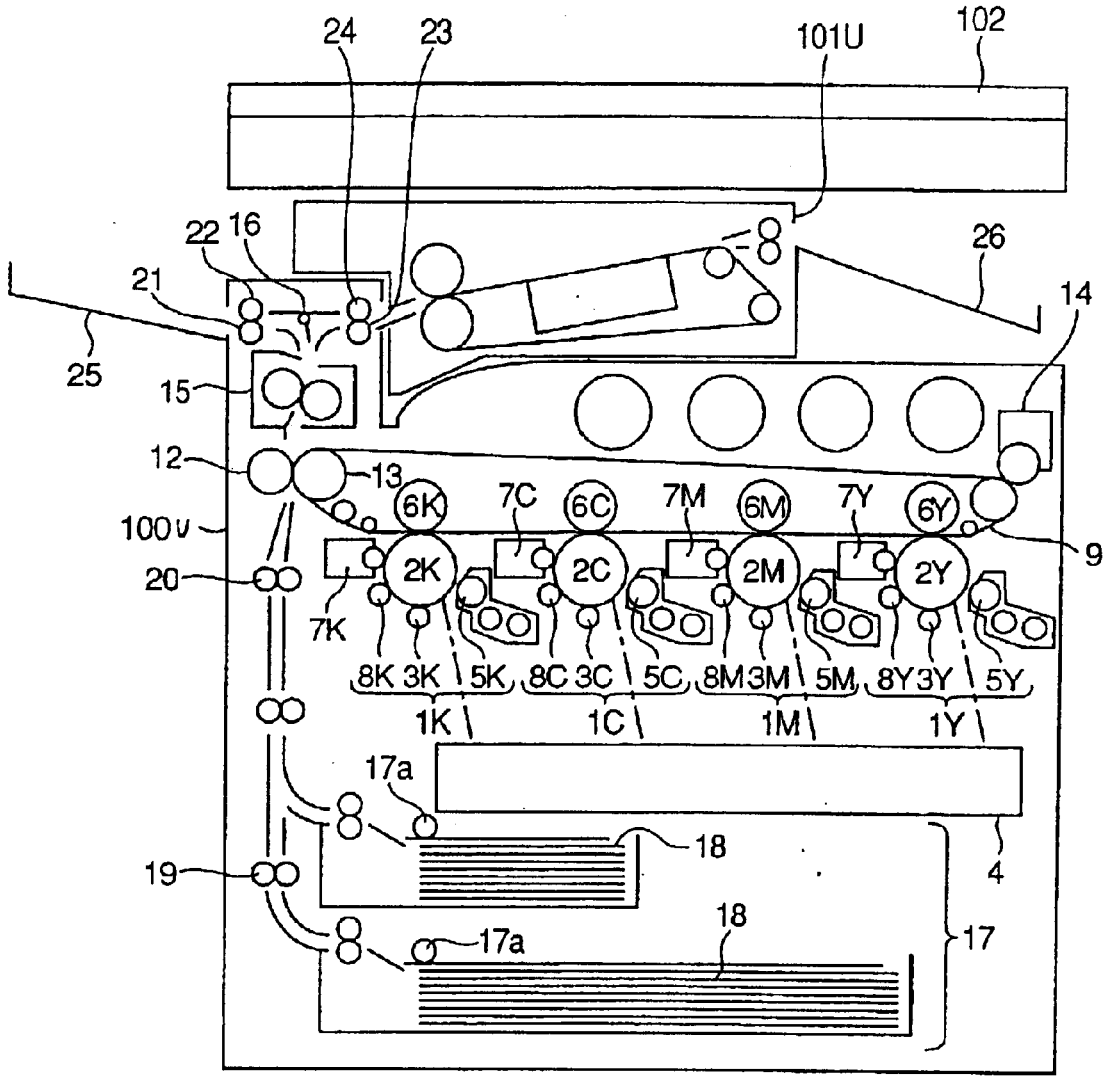
FIG. 14 is a schematic sectional view of an image-forming apparatus according to Embodiment 2 of the present invention.

FIG. 14 is a schematic structural view of a tandem color copying machine (image-forming apparatus) 1 according to this embodiment of the present invention. The copying machine 1 is constituted by an apparatus main body unit (image forming main body unit) 100U, the image reading device (original reading part) 102, and a secondary fixing unit 101U detachable to the apparatus main body unit 100U. Note that the same structural components as those in Embodiment 1 are denoted by the same reference symbols, and description thereof is omitted here.

Here, the secondary fixing unit 101U exists below the image reading device 102, exists above the image forming section (for example, the secondary transfer position), and exists above the first fixing device 15. Also, the secondary fixing unit 101U exists in the region just above the image forming section (for example, the intermediate transfer belt 9) and exists in the region just below the image reading device 102. Further, the entire conveying path for the recording sheet 18 which leads to the secondary fixing unit 101U from the first fixing device 15 exists in the region just above the image forming section (for example, the intermediate transfer belt 9). Further, the vertical component of the primary fixing line, which links the secondary transfer position and the primary fixing position, is substantially in a vertical direction. Moreover, the vertical component of the secondary fixing line, which links the primary fixing position and the secondary fixing position, is smaller than the horizontal component of the secondary fixing line. In addition, the recording sheet 18 discharged from the secondary fixing unit 101U is discharged to the region just above the image forming section (for example, the intermediate transfer belt 9).

The layout described above is adopted, whereby, first, saving of space (particularly in terms of installation area) of the entire apparatus 1 is promoted although the secondary fixing unit 101U is provided. That is, the installation projected area of the copying machine 1, in which the apparatus main body unit 100U is additionally provided with the secondary fixing unit 101U, is substantially equal to the installation projected area of only the apparatus main body unit 100U. Second, the operability of the apparatus 1 is excellent because the recording sheet 18 is discharged at a relatively high position. Third, the secondary fixing unit 101U is provided as a separate unit from the apparatus main body unit 100U, whereby the second fixing device 101 (secondary fixing unit 101U) can be attached to the existing image-forming apparatus (apparatus main body unit 100U) only with the normal print mode. Thus, the image-forming apparatus is realized which can output a high-gloss image (photographic image) and a non-gloss image (general text or the like) without development of a new image-forming apparatus main body.

Figure 15:
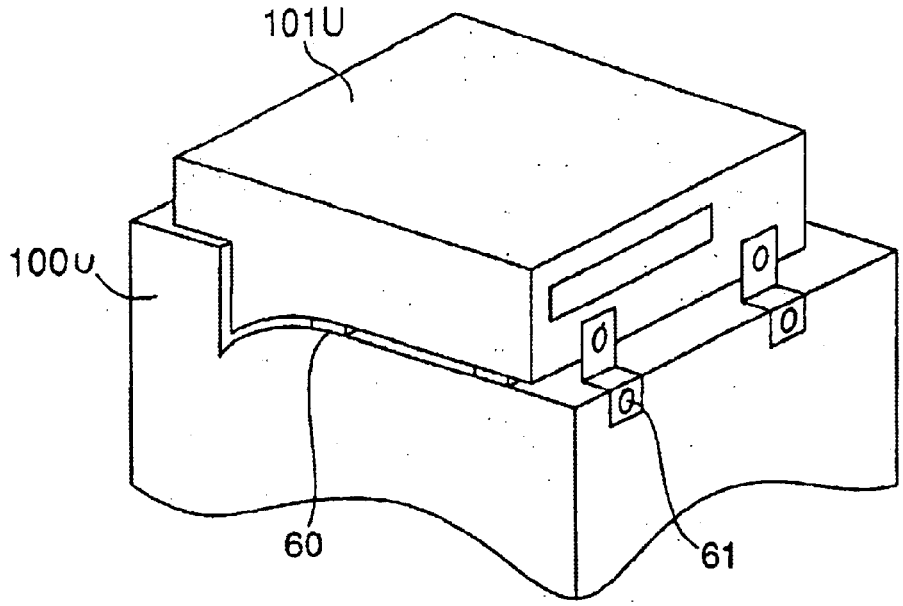
FIG. 15 illustrates a method of fastening a secondary fixing unit.
Figure 16:
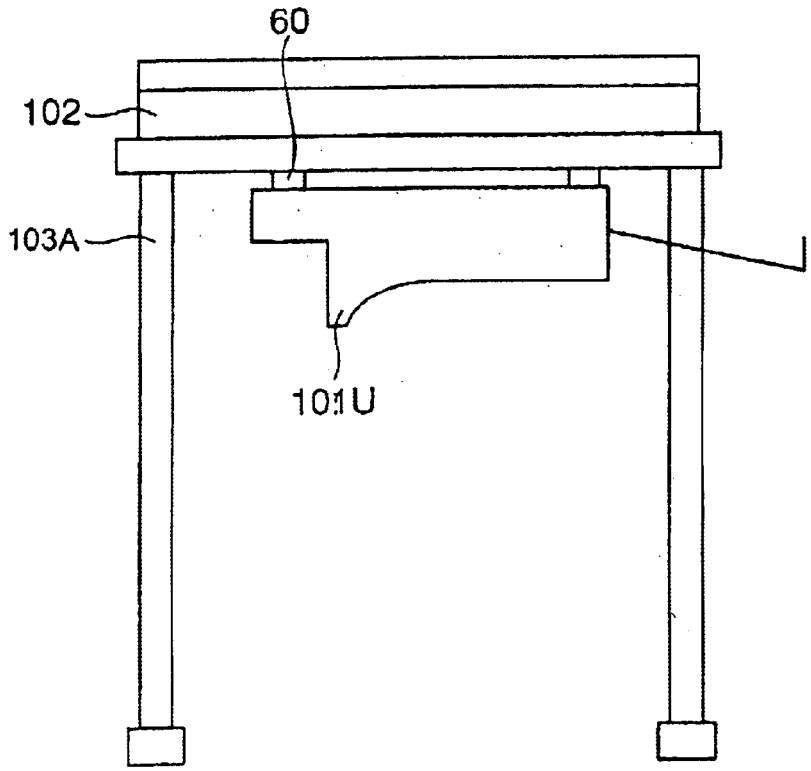
FIG. 16 illustrates a method of fastening a secondary fixing unit.

As to a specific method of arranging the secondary fixing unit 101U, as shown in FIG. 15, plural supporting members 60 and plural fastening sections 61 are provided to, for example, a bottom surface and a side surface of the secondary fixing unit 101U so that the secondary fixing unit 101U can be directly fastened to the apparatus main body unit 100U. Alternatively, as shown in FIG. 16, plural indicating members 60 are provided to an upper surface or side surface of the secondary fixing unit 101U so that the secondary fixing unit 101U can be hung from a bottom surface portion of the image reading device 102 or an image reading device attaching member 103A that supports the image reading device 102, or the like.

Embodiment 3

Figure 17:
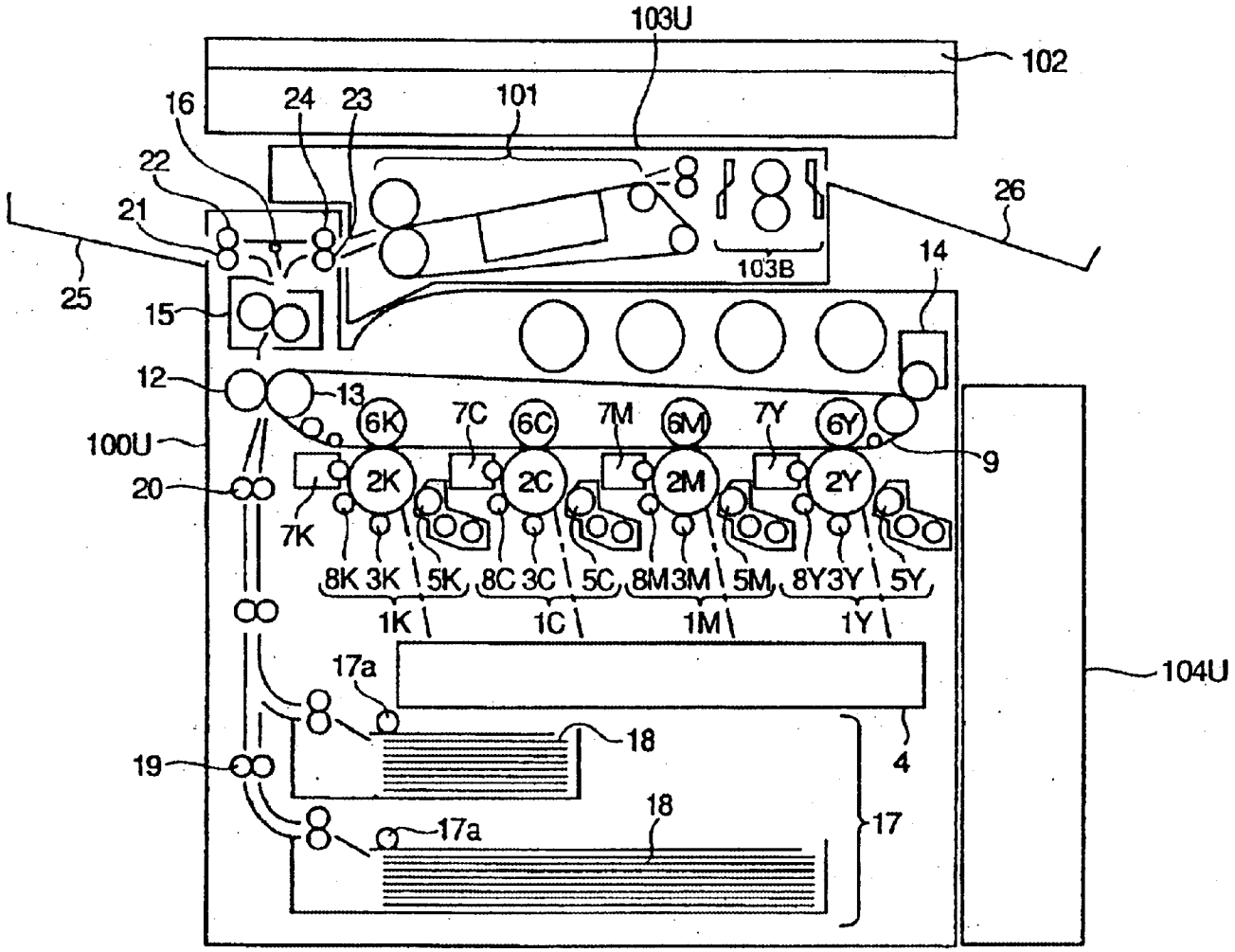
FIG. 17 is a schematic sectional view of an image-forming apparatus according to Embodiment 3 of the present invention.

FIG. 17 is a schematic structural view of a tandem color copying machine (image-forming apparatus) 1 according to this embodiment. The copying machine 1 is constituted by the apparatus main body unit (image forming main body unit) 100U, the image reading device (original reading part) 102, and a post-processing unit 103U detachable to the apparatus main body unit 100U. Note that the same structural components as those in Embodiments 1 and 2 are denoted by the same reference symbols, and description thereof is omitted here.

Provided inside the post-processing unit 103U are the second fixing device 101 and a cutting device (cutting part) 103B that is located on the downstream side, in the conveying direction of the recording sheet 18, of the second fixing device 101. The second discharge tray 26 is provided integrally with the post-processing unit 103U.

The cutting device is provided with guillotine cutters at two locations on the upstream side and the downstream side in the conveying direction, and is provided with a roll cutter between the two guillotine cutters. The dedicated glossy paper 18 (P) to be conveyed is stopped once at a predetermined position, and is cut at an upstream end and a downstream end in the conveying direction by means of the guillotine cutters. On the other hand, the side end portions in the conveying direction of the dedicated glossy paper 18 (P) are cut by the roll cutter during conveyance. Note that a non-image region, which is formed in the peripheral portion of the dedicated glossy paper 18 (P), is cut off by the above-described cutting device 103B. Thus, an image is formed over the entire surface of the dedicated glossy paper (P) similarly to a silver photographic print. Note that the structure of the cutting device 103B is not limited to the above-described one. Any structure may be adapted as along as the dedicated glossy paper 18 (P) can be cut into a predetermined size.

Here, the post-processing unit 103U including the second discharge tray 26 exists below the image reading device 102, exists above the image forming section (for example, the secondary transfer position), and exists above the first fixing device 15. A part of the post-processing unit 103U exists in the region just above the image forming section (for example, the intermediate transfer belt 9) and exists in the region just below the image reading device 102. Further, the entire conveying path for the recording sheet 18 which leads to the post-processing unit 103U from the first fixing device 15 exists in the region just above the image forming section (for example, the intermediate transfer belt 9). Further, the vertical component of the primary fixing line, which links the secondary transfer position and the primary fixing position, is substantially in the vertical direction. Moreover, the vertical component of the secondary fixing line, which links the primary fixing position and the secondary fixing position, is smaller than the horizontal component of the secondary fixing line.

Further, the installation projected area of the image-forming apparatus, in which the image forming main body unit 100U is additionally provided with the post-processing unit 103U, is larger than the installation projected area of the image forming main body unit 100U, and a coin unit 104U serving as a peripheral device of the image-forming apparatus is additionally provided just below a protruded portion (the second discharge tray 26) of the post-processing unit 103U with respect to the image forming main body unit 100U. Note that a prepaid card may be additionally provided instead of the coin unit 104U.

The layout described above is adopted, whereby, first, saving of space (particularly in terms of installation area) of the entire apparatus 1 is promoted although the post-processing unit 103U is provided. That is, the installation projected area of the copying machine 1, in which the apparatus main body unit 100U is additionally provided with the post-processing unit 103U, is substantially equal to the sum of the installation projected area of the apparatus main body unit 100U and the installation projected area of the coin unit 104U. Second, the operability of the apparatus 1 is excellent because the recording sheet 18 is discharged at a relatively high position. Third, the post-processing unit 103U is provided as a separate unit from the apparatus main body unit 100U, whereby the second fixing device 110 (secondary fixing unit 101U) can be attached to the existing image-forming apparatus (apparatus main body unit 100U) only with the normal print mode. Thus, the image-forming apparatus is realized which can output a high-gloss image (photographic image) and a non-gloss image (general text or the like) without development of a new image-forming apparatus main body.

As to a specific method of arranging the post-processing unit 103U, as shown in FIG. 15 in Embodiment 2, the plural supporting members 60 and the plural fastening sections 61 are provided to, for example, the bottom surface and the side surface of the post-processing unit 103U so that the post-processing unit 103U can be directly fastened to the apparatus main body unit 100U. Alternatively, as shown in FIG. 16, the plural indicating members 60 are provided to the upper surface or side surface of the post-processing unit 103U so that the post-processing unit 103U can be hung from the bottom surface portion of the image reading device 102 or the image reading device attaching member 103 that supports the image reading device 102, or the like.

Embodiment 4

Figure 18:
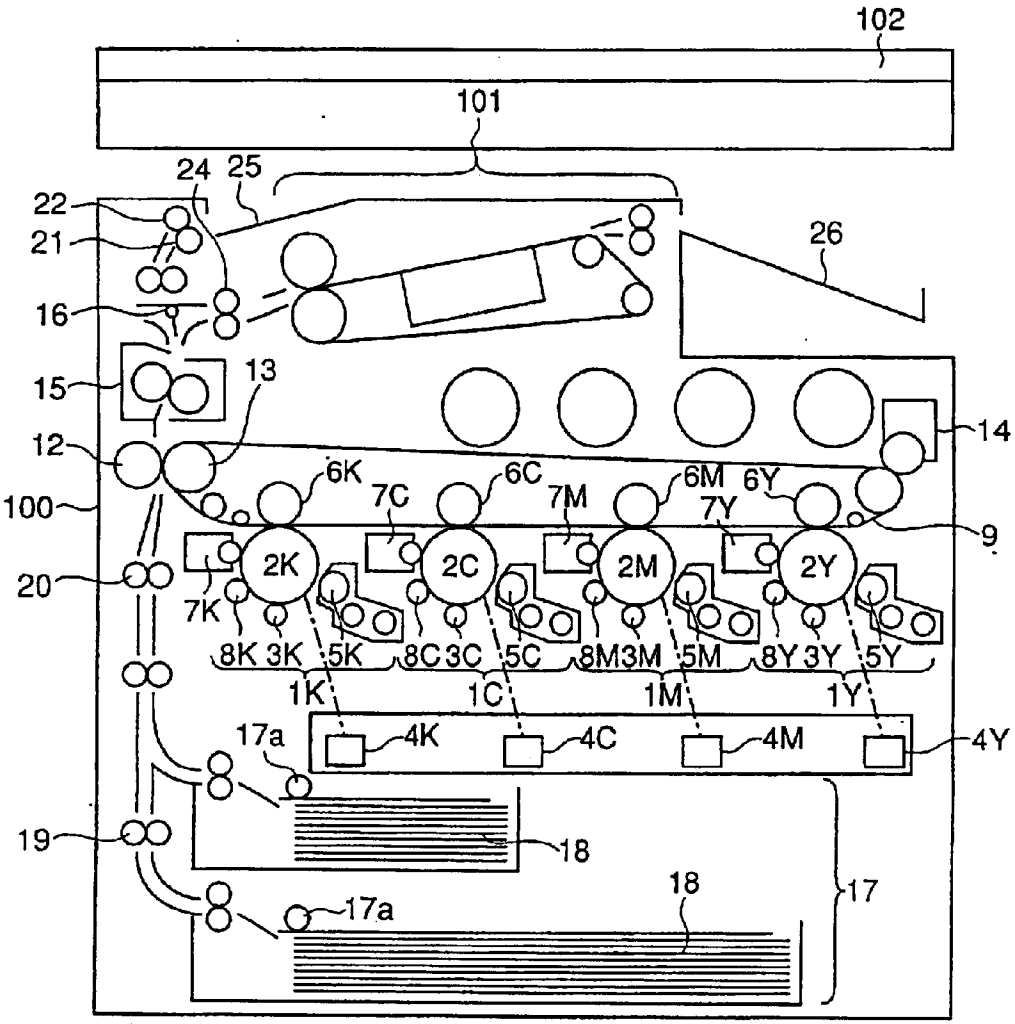
FIG. 18 is a schematic sectional view of an image-forming apparatus according to Embodiment 4 of the present invention.

FIG. 18 is a schematic structural view of a tandem color copying machine (image-forming apparatus) 1 according to this embodiment. This copying machine 1 is constituted by the apparatus main body 100 and the image reading device (original reading part) 102. Further, the image output section and the second fixing device (second fixing part) 101 are built in the apparatus main body 100. The image output section is composed by the first fixing device (first fixing part) 15 and the image forming section (image forming part). In this embodiment, the first discharge tray 25 exists above the second fixing device 101, and a part of the conveying path for the recording sheet which is from the first fixing device 15 extends in the same direction (toward the left side in the figure).

Figure 19:
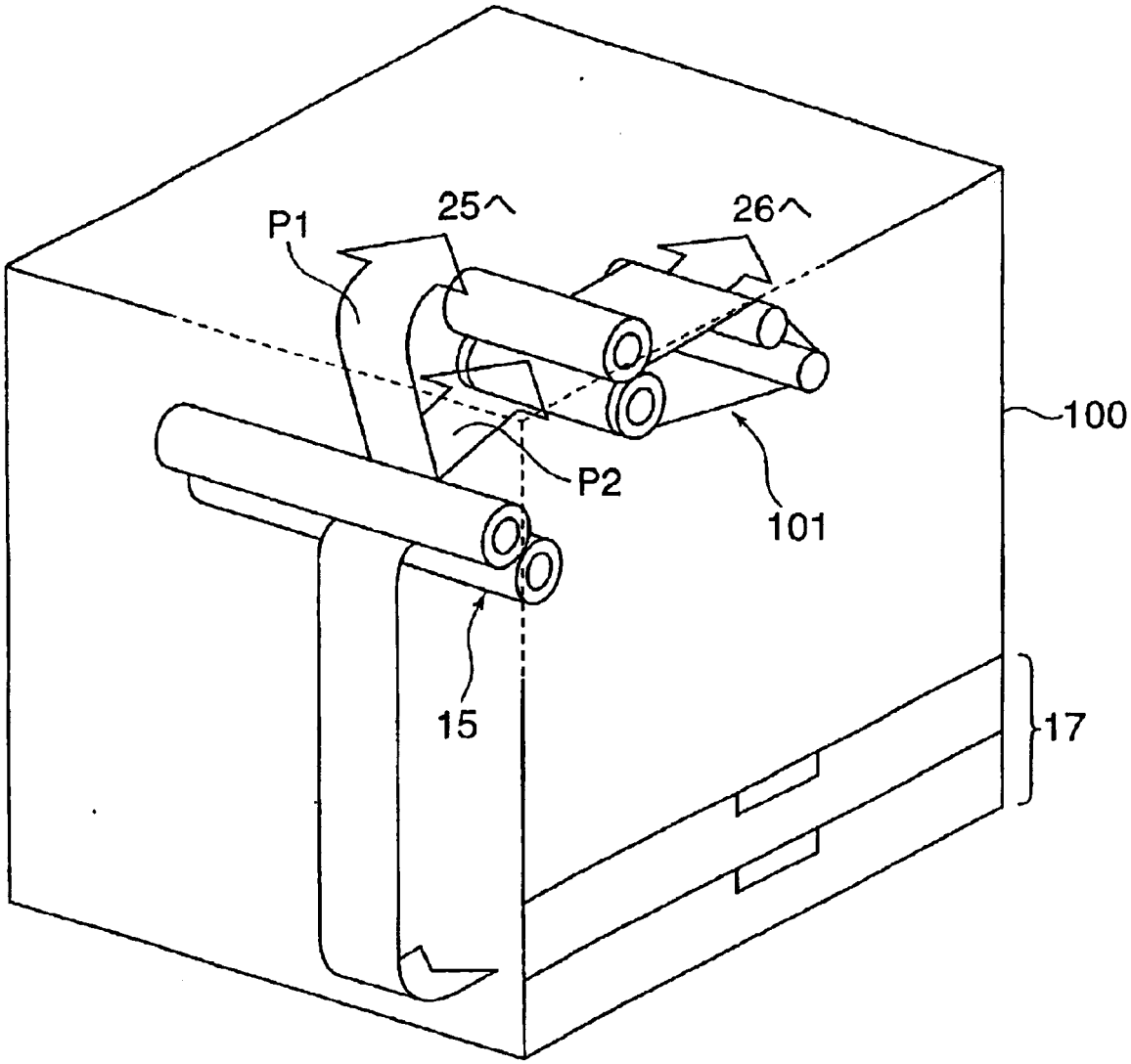
FIG. 19 is a perspective view for explaining a conveying path for a recording sheet of the image-forming apparatus according to Embodiment 4 of the present invention.

FIG. 19 illustrates the conveying path for the recording sheet 18 of the color copying machine 1 in this embodiment. The conveying path P2 for the recording sheet 18 which leads to the second discharge tray 26 from the first fixing device 15 via the second fixing device 101 exists in the region just above the image forming section (for example, the intermediate transfer belt 9). On the other hand, the conveying path P1 for the recording sheet 18 which leads to the first discharge tray from the first fixing device 15 also exists in the region just above the image forming section. Note that the conveying path P for the recording sheet 18 that leads to the first fixing device 15 from the paper tray 17 extends substantially in a vertical direction as in Embodiment 1.

Further, the recording sheet 18 that has undergone fixation in the normal print mode and the recording sheet 18 that has undergone fixation in the high-gloss print mode are both discharged to the portion above the image forming section, particularly the portion just above the image forming section (for example, the intermediate transfer belt 9). That is, the conveying path for the recording sheet 18 in the normal print mode exists above the second fixing device 101.

The layout described above is adopted, whereby, first, saving of space (particularly in terms of installation area) of the entire apparatus 1 is promoted although the second fixing device 101 is provided. Second, the operability of the apparatus 1 is excellent because the recording sheet 18 is discharged at a relatively high position. In addition, third, the installation projected area of the apparatus 1 can be reduced by the amount corresponding to the first discharge tray 25 (compared with Embodiment 1).

Embodiment 5

Figure 20:
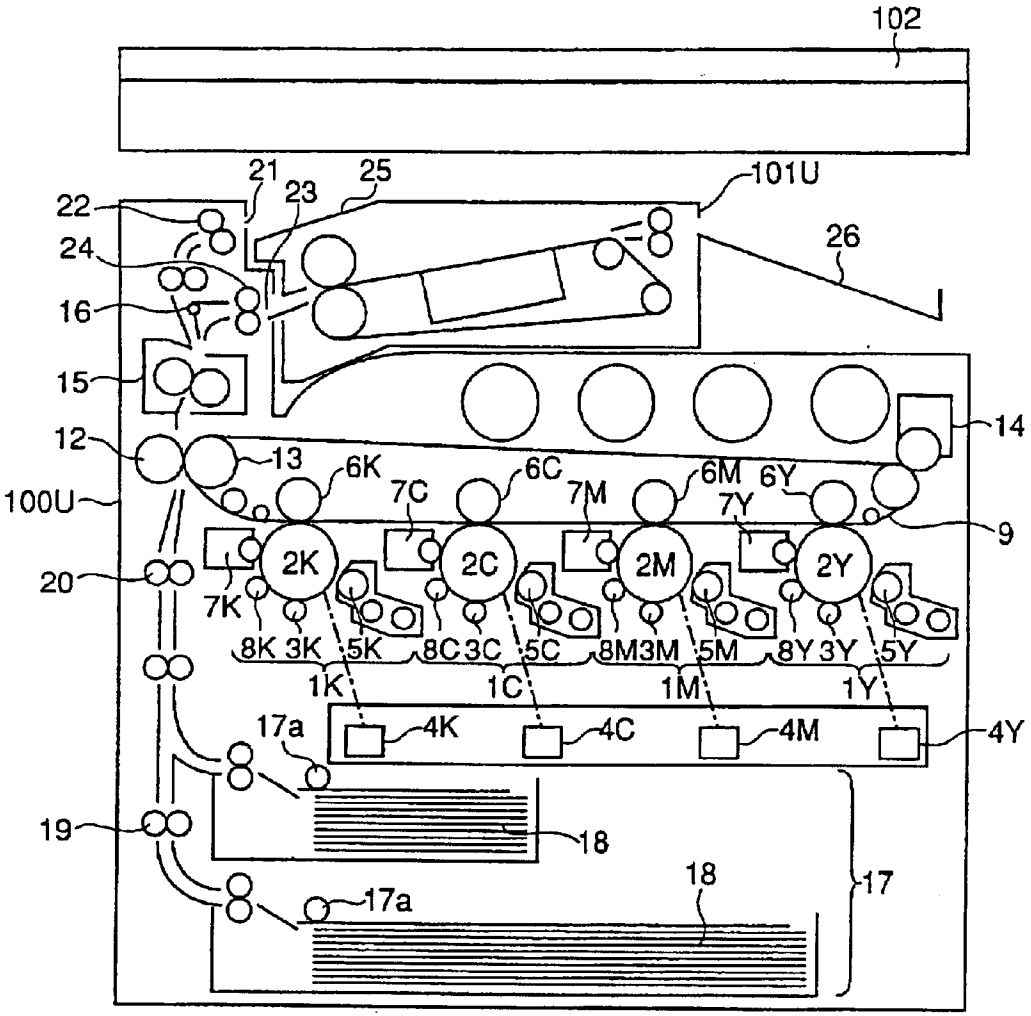
FIG. 20 is a schematic sectional view of an image-forming apparatus according to Embodiment 5 of the present invention.

FIG. 20 is a schematic structural view of a tandem color copying machine (image-forming apparatus) 1 according to this embodiment. The copying machine 1 is constituted by the apparatus main body unit (image forming main body unit) 100U, the image reading device (original reading part) 102, and the secondary fixing unit 101U detachable to the apparatus main body unit 100U. Note that the same structural components as those in Embodiments 1 to 4 are denoted by the same reference symbols, and description thereof is omitted here.

The layout described above is adopted, whereby, first, saving of space (particularly in terms of installation area) of the entire apparatus 1 is promoted although the secondary fixing unit 101U is provided. Second, the operability of the apparatus 1 is excellent because the recording sheet 18 is discharged at a relatively high position. In addition, third, the installation projected area of the apparatus 1 can be reduced by the amount corresponding to the first discharge tray 25 (compared with Embodiment 1). Fourth, the secondary fixing unit 101U is provided as a separate unit from the apparatus main body unit 100U, whereby the second fixing device 101 (secondary fixing unit 101U) can be attached to the existing image-forming apparatus (apparatus main body unit 100U) only with the normal print mode. Thus, the image-forming apparatus is realized which can output a high-gloss image (photographic image) and a non-gloss image (general text or the like) without development of a new image-forming apparatus main body.

What is claimed is:

1. An image-forming apparatus, comprising:

an image forming part that forms an unfixed toner image on a recording sheet;

a first fixing part that performs primary fixation to the recording sheet that bears the unfixed toner image; and a second fixing part that performs secondary fixing to the recording sheet fixed by the first fixing part, wherein:

the second fixing part exists above the image forming part, the image forming part is provided with a belt-shape intermediate transfer member; and the second fixing part exists just above the intermediate transfer member.

2. An image-forming apparatus, comprising:

an original reading part that reads an original to obtain image information;

an image forming part that forms an unfixed toner image on a recording sheet in accordance with the image information;

a first fixing part that performs primary fixation to the recording sheet that bears the unfixed toner image; and a second fixing part that performs secondary fixation to the recording sheet fixed by the first fixing part, wherein the second fixing part exists above the image forming part and below the original reading part.

3. An image-forming apparatus according to claim 1, wherein the second fixing part exists above the first fixing part.

4. An image-forming apparatus according to claim 1, wherein the second fixing part does not exist just above the first fixing part.

5. An image-forming apparatus according to claim 1, wherein:

the image forming part is provided with a holding tray that holds the recording sheet; and a conveying path for the recording sheet which leads to the first fixing part from the holding tray has a vertical direction component larger than a horizontal direction component.

6. An image-forming apparatus according to claim 1, wherein the image forming part is provided with a holding tray that holds the recording sheet; and a conveying path for the recording sheet which leads to the first fixing part from the holding tray extends substantially in a vertical direction.

7. An image-forming apparatus according to claim 1, wherein at least a part of a conveying path for the recording sheet which leads to the second fixing part from the first fixing part exists above the image forming part.

8. An image-forming apparatus according to claim 1, wherein the recording sheet discharged from the second fixing part is discharged to a portion above the image forming part.

9. An image-forming apparatus according to claim 1, wherein the recording sheet discharged from the second fixing part is discharged to a portion just above the image forming part.

10. An image-forming apparatus, comprising:

an image forming part that forms an unfixed toner image on a recording sheet;

a first fixing part that performs primary fixation to the recording sheet that bears the unfixed toner image; and a second fixing part that performs secondary fixing to the recording sheet fixed by the first fixing part, wherein:

the second fixing part exists above the image forming part, the image forming part is provided with a belt-shape intermediate transfer member; and the recording sheet discharged from the second fixing part is discharged to a portion just above the intermediate transfer member.

11. An image-forming apparatus, comprising:

an image forming part that forms an unfixed toner image on a recording sheet;

a first fixing part that performs primary fixation to the recording sheet that bears the unfixed toner image;

a second fixing part that performs secondary fixing to the recording sheet fixed by the first fixing part, the second fixing part being disposed above the image forming part;

an image forming main body unit that includes the image forming part and the first fixing part; and a secondary fixing unit which includes the second fixing part and which is detachable to the image forming main body unit.

12. An image forming apparatus according to claim 11, wherein an installation projected area of the entire image-forming apparatus in which the image forming main body unit is additionally provided with the secondary fixing unit is smaller than the sum of an installation projected area of the single image forming main body unit and an installation projected area of the single secondary fixing unit.

13. An image-forming apparatus according to claim 11, wherein an installation projected area of the image-forming apparatus in which the image forming main body unit is additionally provided with the secondary fixing unit is equal to an installation projected area of the image forming main body unit.

14. An image-forming apparatus, comprising:

an image forming part that forms an unfixed toner image on a recording sheet;

a first fixing part that performs primary fixation to the recording sheet that bears the unfixed toner image;

a second fixing part that performs secondary fixing to the recording sheet fixed by the first fixing part, the second fixing part being disposed above the image forming part;

an image forming main body unit that includes the image forming part and the first fixing part; and a post-processing unit which includes the second fixing part and which is detachable to the image forming main body unit.

15. An image-forming apparatus according to claim 14, wherein the post-processing unit is provided with a cutting part that cuts the recording sheet that has undergone the secondary fixation to have a desired size.

16. An image-forming apparatus according to claim 14, wherein an installation projected area of the entire image-forming apparatus in which the image forming main body unit is additionally provided with the post-processing unit is smaller than the sum of an installation projected area of the single image forming main body unit and an installation projected area of the single post-processing unit.

17. An image-forming apparatus according to claim 14, wherein an installation projected area of the image-forming apparatus in which the image forming main body unit is additionally provided with the post-processing unit is larger than an installation projected area of the image forming main body unit.

18. An image-forming apparatus according to claim 17, wherein:

the installation projected area of the image-forming apparatus in which the image forming main body is additionally provided with the post-processing unit is larger than the installation projected area of the image forming main body unit; and a peripheral device of the image-forming apparatus can be additionally provided just below a protruded portion of the post-processing unit with respect to the image forming main body unit.

19. An image-forming apparatus according to claim 17, wherein:

the installation projected area of the image-forming apparatus in which the image forming main body unit is additionally provided with the post-processing unit is larger than the installation projected area of the image forming main body unit; and a peripheral device of the image-forming apparatus is additionally provided just below a protruded portion of the post-processing unit with respect to the image forming main body unit.

20. An image-forming apparatus according to claim 14, wherein the peripheral device is a coin unit or a card unit.

21. An image-forming apparatus according to claim 14, wherein an installation projected area of the image-forming apparatus in which the image forming main body is additionally provided with the post-processing unit is equal to an installation projected area of the image forming main body unit.

22. An image-forming apparatus according to claim 1, wherein a size of the recording sheet that can be fixed with the second fixing part is smaller than a size of the recording sheet that can be fixed with the first fixing part.

23. An image-forming apparatus, comprising:

an image forming part that forms an unfixed toner image on a recording sheet;

a first fixing part that performs primary fixation to the recording sheet that bears the unfixed toner image;

a second fixing part that performs secondary fixing to the recording sheet fixed by the first fixing part, the second fixing part being disposed above the image forming part;

a control part that selects a first fixing mode that performs primary fixation to the recording sheet only with the first fixing part, or a second fixing mode that performs a primary fixation and secondary fixation to the recording sheet with the first fixing part and the second fixing part.

24. An image-forming apparatus according to claim 23, wherein the recording sheet that has undergone fixation in the first fixing mode and the recording sheet that has undergone fixation in the second fixing mode are both discharged to a portion above the image forming part.

25. An image-forming apparatus according to claim 23, wherein the recording sheet that has undergone fixation in the first fixing mode and the recording sheet that has undergone fixation in the second fixing mode are both discharged to a portion just above the image forming part.

26. An image-forming apparatus according to claim 23, wherein a covering path for the recording sheet in the first fixing mode exists above or below the second fixing part.

27. An image-forming apparatus according to claim 1, wherein:

the second fixing part includes: a heating roll provided with a heating source; at least one tension roll; an endless belt tensioned around the heating roll and the tension roll; and a pressure roll that faces the heating roll while sandwiching the endless belt therebetween; and the recording sheet is pressurized at a nip portion formed by the endless belt and the pressure roll to be adhered to a surface of the endless belt, and is peeled form the surface of the endless belt after conveyance of the recording sheet.

28. An image-forming apparatus according to claim 1, wherein the recording sheet subjected to the secondary fixation with the second fixing part has a thermoplastic resin layer at least on its surface that bears the toner image.

* * * * *